US009482151B2

(12) United States Patent
Moser Rossel

(10) Patent No.: US 9,482,151 B2
(45) Date of Patent: Nov. 1, 2016

(54) DIRECT CIRCULAR ROTARY INTERNAL-COMBUSTION ENGINE WITH TOROIDAL EXPANSION CHAMBER AND ROTOR WITHOUT MOVING PARTS

(75) Inventor: Roberto Felipe Moser Rossel, Santiago (CL)

(73) Assignee: Map Energy SpA, Recoleta, Santiago (CL)

( * ) Notice: Subject to any disclaimer, the term of this patent is extended or adjusted under 35 U.S.C. 154(b) by 414 days.

(21) Appl. No.: 13/997,955

(22) PCT Filed: Dec. 10, 2010

(86) PCT No.: PCT/CL2010/000050

§ 371 (c)(1),
(2), (4) Date: Apr. 28, 2015

(87) PCT Pub. No.: WO2012/075595

PCT Pub. Date: Jun. 14, 2012

(65) Prior Publication Data

US 2014/0026845 A1 Jan. 30, 2014

(51) Int. Cl.

| | |
|---|---|
| ***F02B 53/04*** | (2006.01) |
| ***F02B 53/00*** | (2006.01) |
| ***F01C 1/356*** | (2006.01) |
| *F01C 11/00* | (2006.01) |

(52) U.S. Cl.

CPC ..... *F02B 53/00* (2013.01); *F01C 1/356* (2013.01); *F01C 11/002* (2013.01)

(58) Field of Classification Search

CPC .... F01C 1/3562; F01C 11/002; F01C 1/356; F02B 53/00

USPC ..... 123/200, 232, 248, 285, 258, 253; 418/248; 60/36.6–39.63

See application file for complete search history.

(56) References Cited

U.S. PATENT DOCUMENTS

| | | | | |
|---|---|---|---|---|
| 3,810,724 A * | 5/1974 | Luukkonen | ..... | 418/248 |
| 4,715,338 A * | 12/1987 | Pasquan | ..... | F01C 1/46 123/248 |
| 6,347,611 B1 | 2/2002 | Wright | | |
| 2002/0007815 A1* | 1/2002 | Oh et al. | ..... | 123/236 |

FOREIGN PATENT DOCUMENTS

| | | | | |
|---|---|---|---|---|
| BE | 383421 A * | 11/1931 | ..... | F01C 1/356 |
| GB | 191005909 A | 5/1910 | | |
| GB | 191404670 A | 2/1914 | | |
| WO | 2008091231 A1 | 7/2008 | | |

OTHER PUBLICATIONS

Translation of BE 383421 A, Oct. 1, 2014, entire document.*

(Continued)

*Primary Examiner* — Nicholas J Weiss
*Assistant Examiner* — Jason T Newton
(74) *Attorney, Agent, or Firm* — LeClairRyan, a Professional Corporation

(57) ABSTRACT

Direct circular rotary internal-combustion engine with toroidal expansion chamber and rotor without moving parts, which directly converts the combustion expansion into a rotary movement of the shaft thereof, receives the compressed oxidizing agent at high pressure, does not require inertia in order to function, and in which combustion can take place in a static combustion chamber.

16 Claims, 32 Drawing Sheets

(56) References Cited

OTHER PUBLICATIONS

Figure 1:
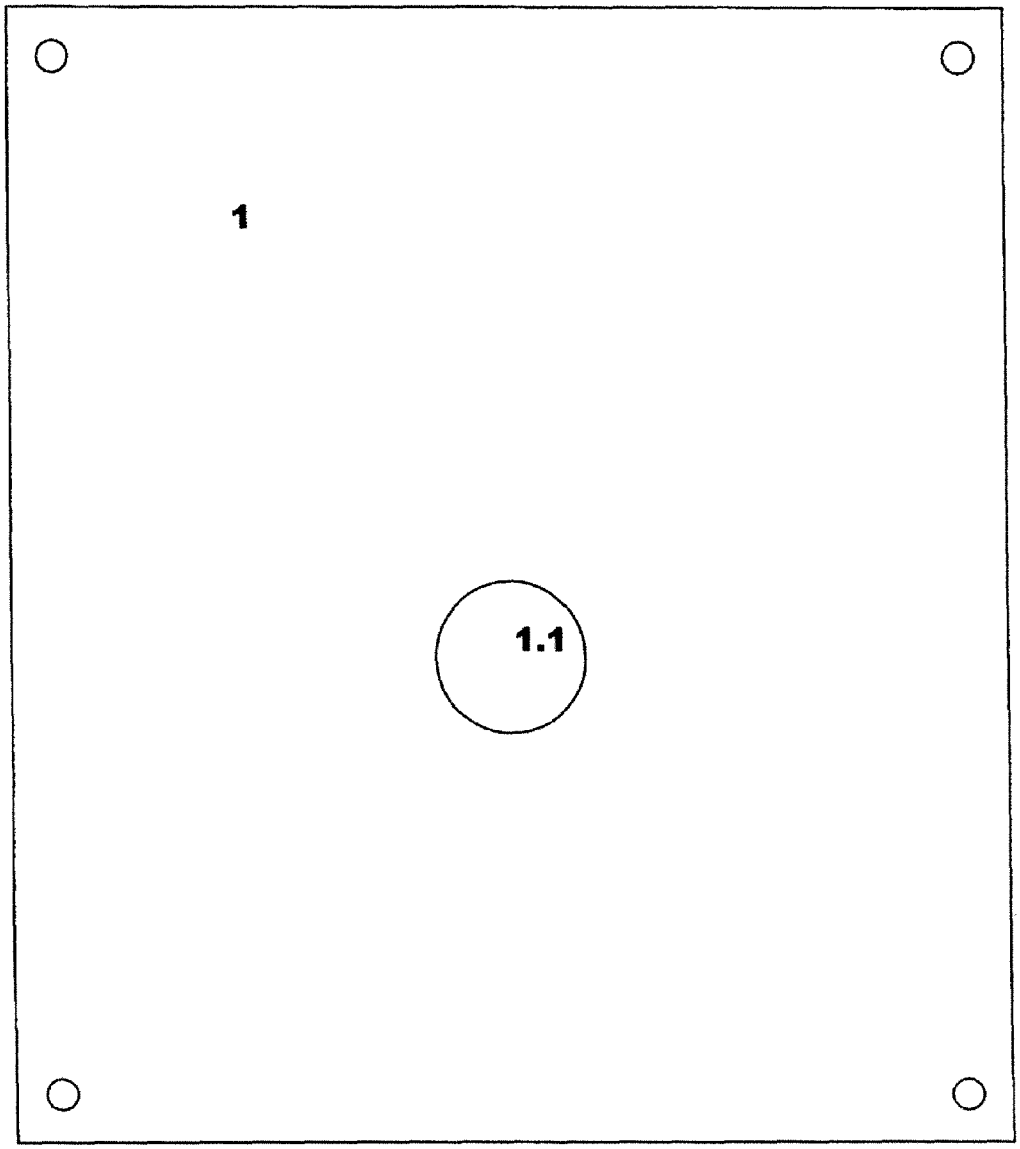

International Search Report and Written Opinion for PCT/CL2010/000050 mailed Aug. 29, 2011.

Notice of Preliminary Rejection for corresponding Korean Patent Application No. 10-2013-7018077, 4 pages (mailed Jun. 1, 2016).

Notice of Preliminary Rejection for corresponding Korean Patent Application No. 10-2013-7018077, 5 pages (mailed Jun. 1, 2016) (English Translation).

* cited by examiner

DIRECT CIRCULAR ROTARY INTERNAL-COMBUSTION ENGINE WITH TOROIDAL EXPANSION CHAMBER AND ROTOR WITHOUT MOVING PARTS

The direct circular rotary internal combustion engine with toroidal expansion chamber and rotor without moving parts transforms directly combustion energy into rotary motion of the shaft. The engine does not perform compression of an oxidizer, which is provided externally, at high pressure. To run the engine, fuel is injected into the combustion chamber with a high-pressure oxidizer and upon activation of an ignition, combustion is produced. If we consider that the process of combustion is a direct rotary motion, i.e. there are no mechanical losses transforming linear movements into circular movements, and there is no need to keep the inertia of the cycle working, since compression of the oxidizer is external, an internal combustion engine can be achieved that is significantly more efficient, simple, and economical than alternatives currently in use. If the entry of the oxidizer is at high pressure and high temperature, the mixture may combust spontaneously, without the need for an ignition system. Due to mechanical configuration it can achieve very high pressures. It is formed by two solid side plates containing a third solid plate with a central cylindrical recess, with five recesses reaching the central cylindrical face of the recess, containing the inlet valve of the oxidizer at high pressure, the spark plug of the fuel combustion, the fuel injection valve, the expansion valve, and the exhaust valve, which can be replaced by a free outlet to the outside. The space formed by the two side walls, the central plate or solid body with the central cylindrical recess, contains the solid cylindrical rotor expander with an expander head which protrudes from the circular or cylindrical line of this and is perfectly adjusted to the side and fits perfectly with the face of the solid cylindrical recess fixed body. The expander rotor is traversed by a fixed axle at its geometric cylindrical center, coinciding with the center of the cylindrical recess of the body and passes through the perforations, having for this purpose, the side plates, through which transmits the rotary motion, produced by the expansion of the combustion chamber, to the outside. The expansion chamber is the space between the two side plates, the cylindrical face of the recess of the solid body, the cylindrical face of the rotor, the front rotor expander head and the front of the expansion valve, shutting the last toroidal section of the chamber. The expansion valve always stays in contact with the cylindrical face of the rotor expander producing a sealing adjustment. This expansion valve is a key component of the engine, which contains the expanding fluid. The sealing contact maintained with the cylindrical face of the rotor is achieved by a mechanical element such as a spring or a pneumatic element such as a piston. The expansion valve in form and angle at which it is located, is very strong and can achieve very high pressures. The valve can also be contained in a recess on each side, which increases its strength. Toroidal volume space that is not used as an expansion chamber, which is limited by the rear face of the expansion valve and the rear face of the head expander rotor, is the rear chamber, which always is at external pressure or atmospheric pressure, and enables lubrication of the parts of the combustion chamber of the engine. The fuel injection valve, the inlet pressure oxidizer valve, the ignition plug and the exhaust valve have characteristics typical of their function. The circular rotor has no moving parts, i.e. the setting with the cylindrical recess wall of the body is constant, which also allows it to reach very high pressures and hence very high expansion ratios. The adjustment of all parts acting in the expansion is given by known mechanical and hydraulic elements.

Well known rotary internal combustion engines perform compression and expansion in an operating cycle. The most widespread are the radial arrangement of the pistons and the Wankel engine. The former are only a variation of the universally known piston cylinder configuration. The Wankel engine is really a four-stroke rotary engine. Its mechanical configuration produces compression and combustion chambers, which cause the prism-shaped rotor and slightly convex sides to perform a movement of rotation and translation which through a cylindrical internal gear transmits the motion to a splined shaft, which finally turns. This engine is very smooth, without vibrations, because it does not transform linear movements into circular movements, but it is quite complex and more than eighty years after its invention there are still no alternatives to conventional engines.

Figure 2A:
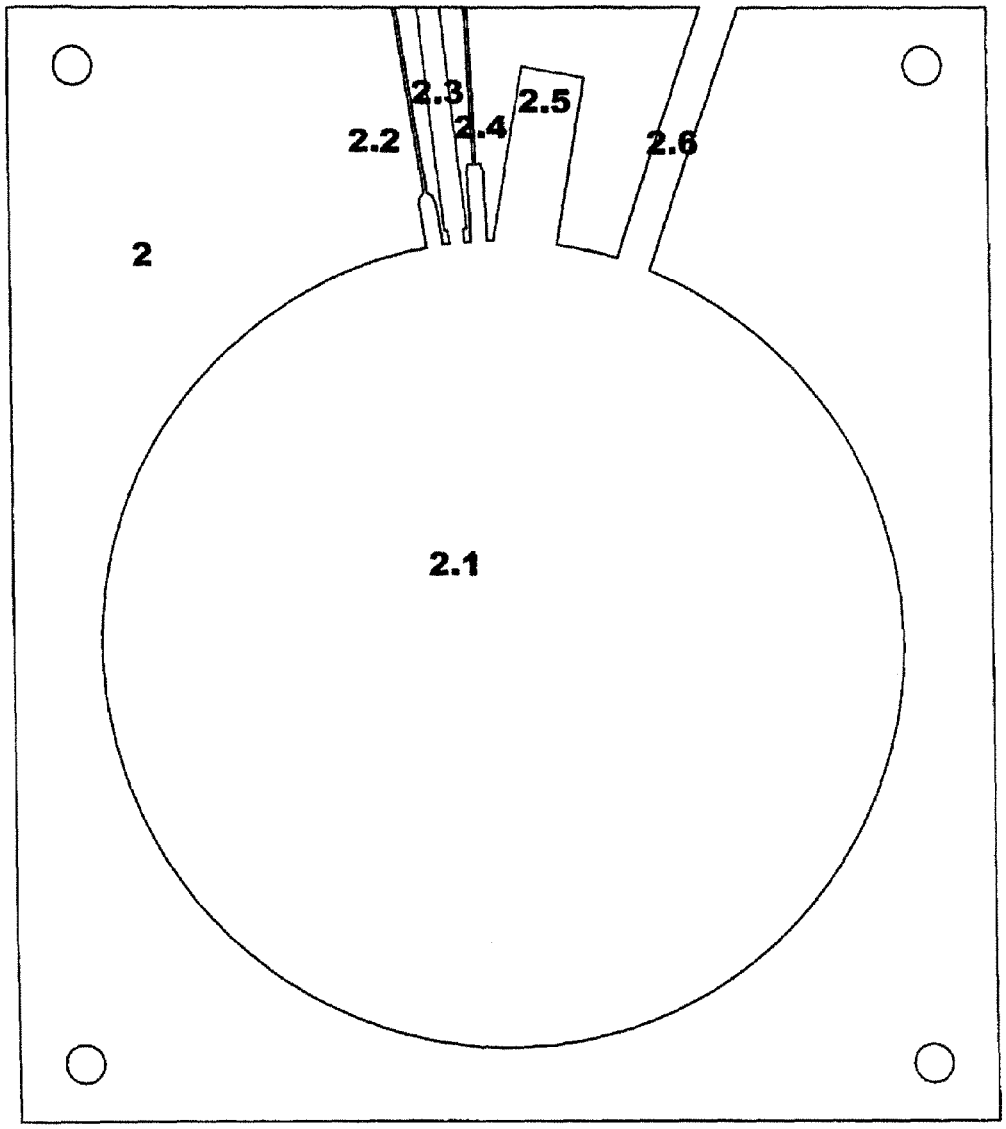

The present invention, Direct Circular Rotary Internal Combustion Engine with Toroidal Expansion Chamber and Rotor without Moving Parts, transforms combustion energy directly into rotary motion of the shaft, and is formed by a solid side plate (1) with a circular hole (1.1) in the center, FIG. 1, a solid body (2) fixed to the solid side plate (1) with an inner cylindrical recess (2.1) whose inner face has the inner recess (2.2), the inner recess (2.3), the inner recess (2.4), the inner recess (2.5), and the inner recess (2.6), FIG. 2A. In these recesses are housed the intake valve (5), the spark plug (6), the fuel injection valve (7), the expansion valve (8), and the exhaust outlet, respectively. To fix the solid body (2) to the side plate (1), the perforation (1.1) is centered in the cylindrical recess of the solid body (2.1), FIG. 2B. In this space, formed by the side plate and the inner cylindrical recess (2.1) is located the expander rotor (3) crossed in its center by a shaft (3.1), which is fixed by a cotter pin (3.2), FIG. 3, which passes through the circular hole (1.1) on the side plate (1). The head expander (3.3) for the expander rotor (3) is perfectly matched with the face of the cylindrical recess of the body (2), FIG. 4A. On top of this set, FIG. 4B, is fixing the second side (11), FIG. 5, which is the mirror image for the side plate (1) and is also traversed by the fixed shaft (3.1) of the expander rotor (3) through its circular hole (11.1). The formed space contained between the two lateral (1) and (11), the inner circular recess (2.1) of the body (2) and the rotor expander (3) is the expansion chamber (9) contained between the front of the expander head (3.3) and the front of the expansion valve (8). The rear chamber (10) is the volume remaining between the rear face of the expander head and the rear face of the expansion valve (8).

Figure 8:
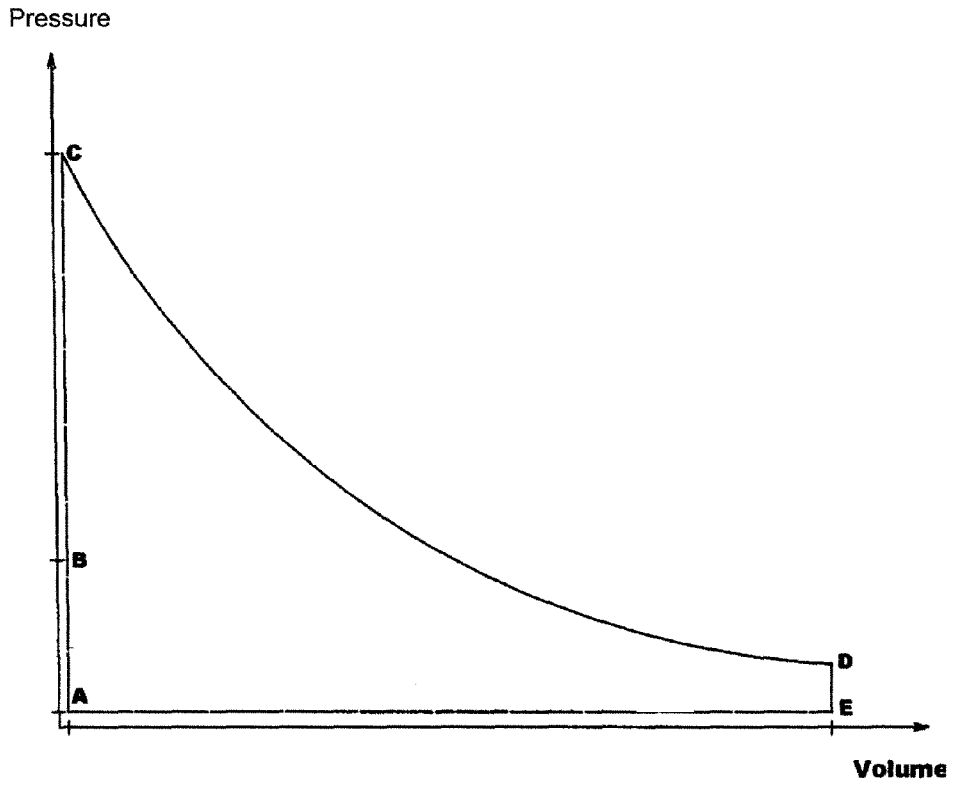
Figure 9:
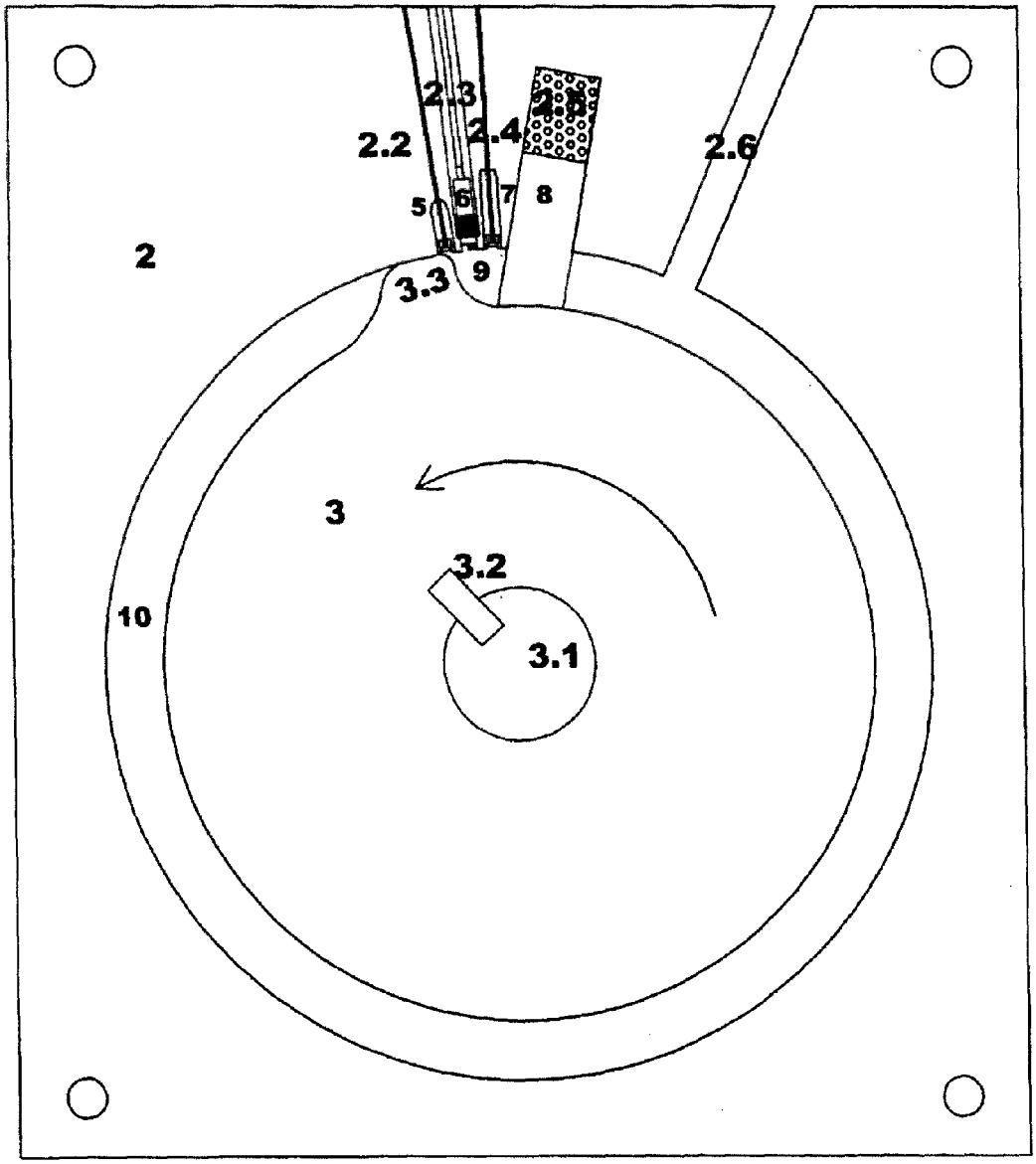

The theoretical cycle of the constant internal volume combustion for the direct circular rotary engine with toroidal expansion chamber and rotor without moving parts can be seen in FIG. 8 and begins at point A with a combustion chamber (9) in its minimum volume at external pressure, FIG. 9, with oxidizer inlet valve (5) and the fuel injector (7) closed, spark plug (6) off. The oxidizer inlet valve (5) at high pressure is opened and the injection of the fuel (7), increasing the pressure of the combustion chamber (9), FIG. 10, to point B in the cycle. At this point, the inlet and injection valves are closed, and the spark plug (6) is ignited causing combustion, FIG. 11, all in an isochoric process, reaching point C of the cycle, which is the maximum pressure at the minimum volume. From there, an adiabatic expansion occurs, FIG. 12, to reach point D of maximum volume and minimum expansion pressure, which is where the expander head reaches the exhaust outlet, FIG. 13, dropping the pressure to match the outside, at point E. At this point the expansion chamber (9) disappears, FIGS. 14 and 15, since the expansion valve (8) rises to permit the pass of the expander head (3.3). This stretch of the cycle concludes with the formation of the combustion chamber (9) in its minimum volume and, since everything is made at external pressure, was plotted as a constant volume reduction at external pressure, coming back to point A, FIG. 16. In FIG. 17, the theoretical isobaric cycle of internal combustion expansion can be seen, which occurs at constant pressure to reach an adiabatic expansion curve to reach the minimum pressure of expansion. This cycle is a spontaneous combustion process that occurs when one enters the oxidant at high pressure and temperature, injects the fuel and begins a burning without a spark plug ignition.

Since the oxidant at high pressure is supplied externally to the engine, regardless of the position of mechanical cycle, a chamber can be added to the structure of the engine, in this case in the solid body (2), that receives this oxidant at high pressure that by adding an injection of fuel and the ignition for the spark plug, transforms it into a static combustion chamber (12), which receives the oxidizer and fuel in an optimal blend in order to maximize the performance of combustion. This chamber forms static combustion chamber (12) of the solid body (2) which receives the recess (2.2), recess (2.3), and recess (2.4) containing the pressured oxidizer inlet valve (5), the spark plug (6), and the fuel injection valve (7) respectively, FIGS. 19 and 20. The static combustion chamber (12) is connected to the expansion chamber (9) by a bypass valve (13).

Figure 21:
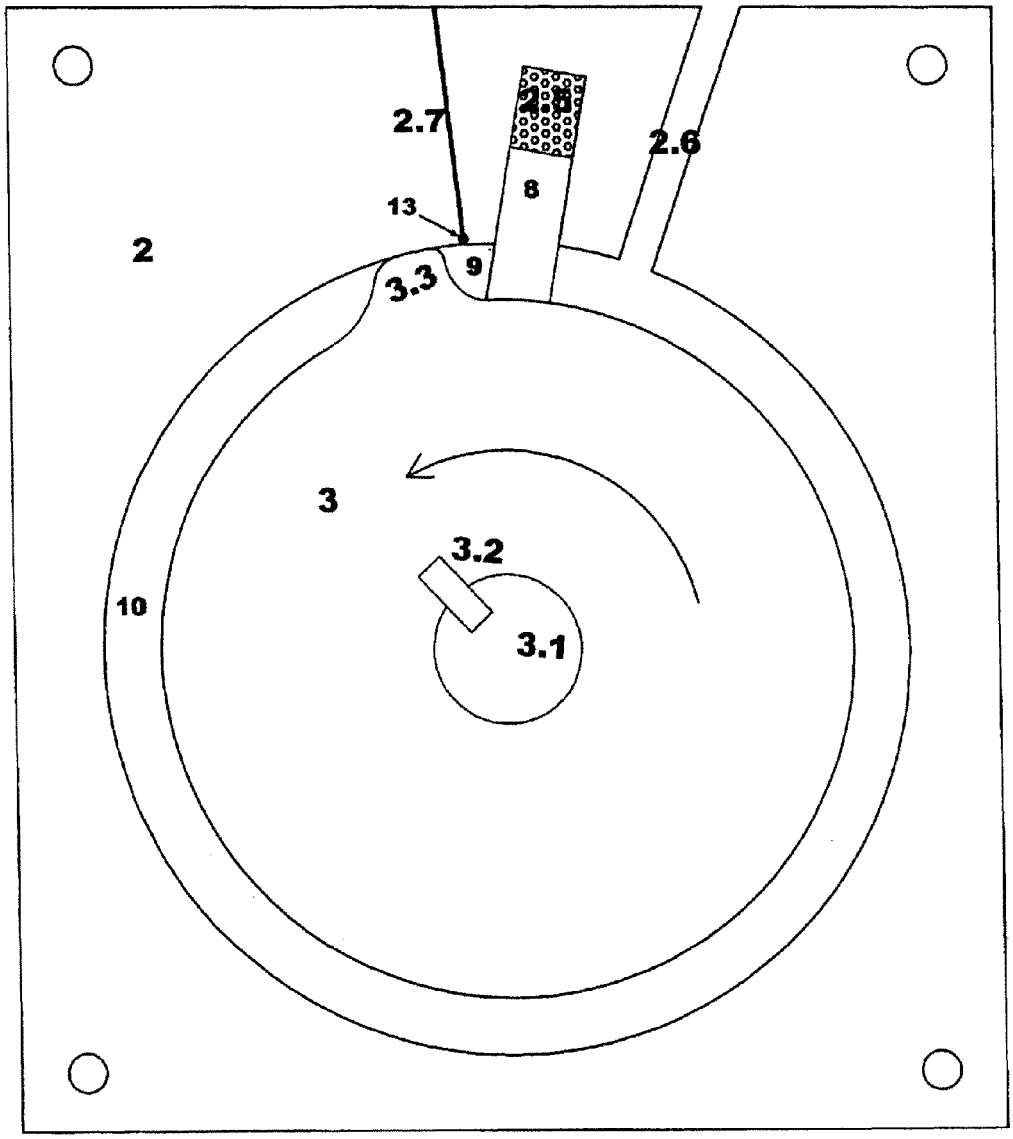

By removing the structure of the direct rotary circular internal combustion engine with toroidal expansion chamber and rotor without moving parts, the static combustion chamber, we have a physically external combustion engine, where the product of the external combustion enters to the expansion chamber through recess (2.7) that reaches the bypass valve (13), which is what regulates admission to the expansion chamber (9), FIG. 21. The bypass valve (13) can be replaced by the intake valve of the high pressure fluid (14) contained in a recess (2.8), FIG. 22. If we replace the external combustion with a compressed gaseous fluid, we would have a compressed gas motor. The most widely used rotary compressed gas motors are those of piston, radial and axial, vane, gear, and turbine motors, which are for high speed and very small power.

If, in the compressed gas motor, the pressurized gas is replaced by hydraulic pressure fluid, it becomes a hydraulic motor, with a robust and efficient mechanical configuration. The rotary hydraulic motors most widely used are the rotary axial piston, vane, and gear.

The range of efficiency of the internal combustion engine direct rotary circular with toroidal expansion chamber and rotor without moving parts is increased by having several expansion chambers containing the same rotor that can be used in different combinations according to requirements. This is accomplished by changing the direction of work of the expansion chamber, which happens to be radial, as shown in the location of the valves, which are lateral. In other words, the valves operate on the side of the toroidal chambers of expansion, which for this purpose is constructed from concentric circular grooves (17.1) contained in the lateral expander rotor face (17), FIG. 23. This lateral expander rotor (17) is contained in the central cylindrical recess (16.1) of the solid plate (16), with through-hole (16.2) at its geometric center, FIG. 24, to form a perfect fit to rotate inside, FIG. 25. The lateral expander rotor (17) in each of the concentric circular grooves (17.1) has an expander head (17.2). As in the radial alternative, the rotor (17) is crossed at its center by a fixed axis (3.1), which crosses to the outside of the solid side (16) through the solid lateral plate drilling (16.2). The solid side plate (18), FIG. 26, closes the concentric toroidal expansion chambers and contains the recesses (2.81) and (2.61) for each respective groove, which houses the intake valves (14), the expansion valves (8.1), and the exhaust recesses (2.6), with outputs (2.81) and (2.61), respectively, being visible for each of the expansion chambers. Solid side plate (18) allows the passage of the fixed shaft (3.1) of the lateral expander rotor (17) by a through-drilling (18.1). In FIG. 27, there is an engine visual cutting, along the groove, where the solid side (16) is containing the lateral expander rotor (17) with the expander head (17.2), the other solid side (18) containing the recesses (2.8) and (2.51) housing the intake valve (14) and the expansion valve (8.1), the exhaust recess (2.6) and the outputs (2.81) and (2.61). Expander head face (17.2), the sidewalls and bottom of the concentric circular groove, the inner solid side (18), is forming the side cover and the expansion valve (8.1) make up the expansion chamber (9). The rest of the circular concentric grooves make up the rear chamber. The expansion valve (8.1) working perpendicular to the face of the rotor expander (3) must enter at right angles so as to achieve a perfect fit and sealing. By external mechanisms controlling the admission of pressurized fluid to the expansion chamber, which depending on the external requirements, may use different alternatives of expansion chambers or combinations thereof, depending on what is needed to produce more torque or higher speed rotation. Even though the scheme does not show fuel injection valves and spark plugs, their inclusion is another valid alternative, only their use becomes more apparent by entering the product of combustion of a static chamber, compressed gas, or hydraulic pressurized fluid flow in the expansion chamber (9) of the rotor side (17). This lateral expander rotor configuration allows the engine to have variable speed. In the case of replacing the high pressure fluid for hydraulic pressurized flow, it creates a hydraulic motor with variable speed.

The common element of the alternatives of the direct circular rotary internal combustion engine with toroidal expansion chamber and rotor without moving parts is the rotation of the motor shaft by the action of fluid pressure on the head expander rotor, to produce either internal combustion, the expansion of a pressurized gas, combustion or external compression chamber, or by flow and pressure of a hydraulic fluid. If we reverse the direction of rotation of the rotor by applying a rotational force to the fixed shaft and maintain the intake valve pressure gas (14) located in the recess (2.8), it becomes an output valve which changes the direction of fluid that enters through the exhaust outlet (2.6), which is open to the outside and is pressed against the expansion valve, which is now called compression valve (8), maintaining its function, and compressed by outtake valve (14). With this change, the fluid instead produces a fixed axis rotation of the rotor, the rotation of the shaft produces the rotation of the rotor, which through the compressor head (3.3) compresses the fluid in the compression chamber (9) against the compression valve (8), out by the outlet valve (14), in this way we have a compressor which is a robust and efficient mechanical configuration, FIG. 28.

Figure 28:
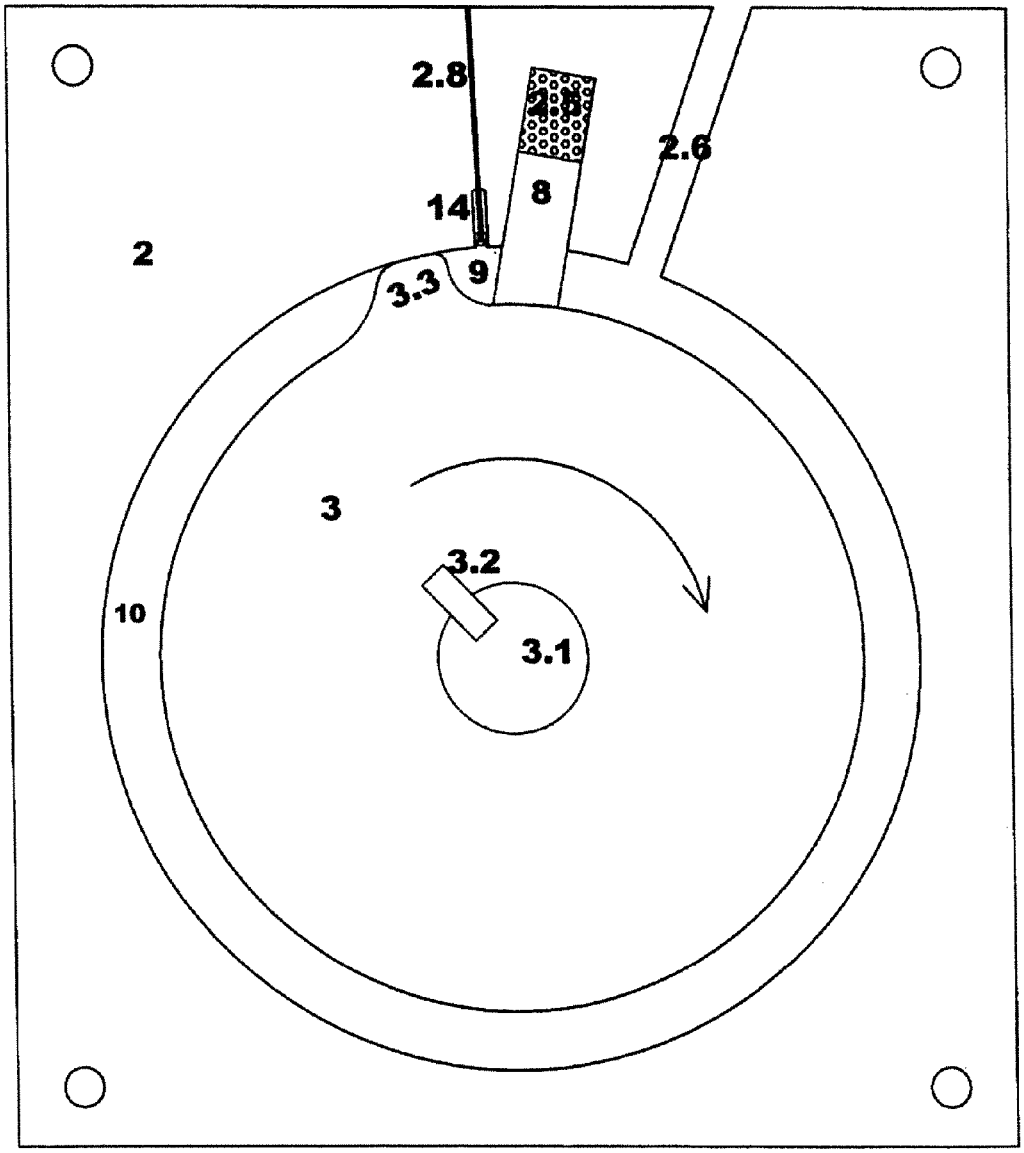

Direct circular rotary compressor with toroidal compression chamber and rotor without moving parts, like direct circular rotary engine, is formed by a side plate (1) with a circular drilling in the center (1.1), a solid body (2) with an inner cylindrical recess (2.1) fixed to the solid side plate (1) in whose open duct (2.6) leaves free admission, a second cavity (2.5) that houses the compression valve (8) and a third recess (2.8) that houses the outlet valve (14), FIG. 28. The rest of the compressor configuration is identical to the direct circular rotary motor where expansion is renamed compression. The space contained between the sides (1) and (10), the inner circular recess (2.1) of the body (2) and the compressor rotor (3) form the compression chamber (9) in the volume contained between the front compressor head (3.3) and the front of the compression valve (8) and where the outlet valve is. The inlet chamber (10) is the area where the intake recess (2.6) is contained and is located below the compression valve and compressor head back. The compressor rotor has no moving parts, i.e. the setting with cylindrical recess wall (2.1) of the solid body (2) is constant, which allows reaching high compression ratios. When compression valve (8) comes into contact with the beginning of the compression head (3.3), the contact no longer forms a perfect seal and the compression excess remaining in the compression chamber passes to the inlet chamber that is open to the outside. If the opening between the chamber and the outside (2.6) is replaced by a cavity (2.9) to install therein a inlet valve (15) and grooves (3.4) along the face of the compressor head (3.3), FIGS. 29 and 30, then with the inlet valve (15) closed, the rear chamber (10) fills with air to external pressure when the compressor head (3.3) touches the compression valve (8), and passes this excess of compressed air to the compression chamber and the compression cycle begins with a greater pressure than external, achieving greater compression ratios in the chamber. The adjustment of all elements acting in the compression process is given by mechanical and hydraulic elements known. This surplus compression can be passed externally to the compression chamber, cooling it on the way, which makes more efficient compression. By replacing the gaseous fluid by hydraulic fluid we have a hydraulic pump with a simple mechanical configuration, robust and efficient.

The best-known rotary compressors are those that work with vanes and the screw system. In the first case the rotor is eccentrically located in the chamber containing, in slots, a set of vanes which are kept in contact with the wall of the compression chamber during rotation thereof, darting in and out of the slots in bracket. The contact angle of the blades to the chamber wall is variable, so it does not allow the settings to seal to achieve great compression ratios. In the case of the screw compressor, it has higher performance than the paddle, but also much higher mechanical complexity and cost.

By analyzing the cycle of a conventional internal combustion engine, Otto or Diesel, the three basic steps are compression, combustion, and expansion, all conducted within the same chamber. It is difficult to expect that the mechanical configuration that performs these three stages, in the same chamber, can approach high efficiency levels in each process. On the other hand, it is normal that to perform a stage, you add constraints to the other, to cohabit within the same mechanical configuration. Separating the basic stages of the cycle in different chambers can achieve optimum mechanical configurations for each of them. That is, a compressor that reaches very high compression ratios and is limited only by mechanical components, a static combustion chamber whose design is to obtain the best oxidized fuel mixture to obtain the most efficient combustion, along with the ability to control when the combustion is performed, and an expansion chamber which allows one to obtain the maximum working reaching expansion ratios of the efficient combustion and are limited only by the efficiency of itself. Nor is it necessary that all steps are performed in sequence. Compression can be done perfectly in static installations and provided packaged for use in mobile or autonomous mechanisms, as would use compressed air or oxygen, in gas tank.

A traditional four-stroke engine provides only positive work in 25% of the cycle, which comprises two full turns of the shaft. The remainder of the cycle is performed by the inertia produced by the flywheel and the mechanical configuration by itself, such as the crankshaft, etc. A direct circular rotary internal combustion engine with toroidal expansion chamber and rotor without moving parts performs mechanical work at 90% of the cycle, corresponding to an axis rotation. Then a direct rotary engine circular requires an expansion chamber equivalent to 28% of the combustion chamber of a four-stroke engine. In a traditional engine, more than two thirds of their weight is given by the mechanism which converts the linear motion of the pistons within the cylinders into rotary motion. Also, this rotation of the motor should be maintained by a high inertia. For this, the crankshaft rotation of the engine is isolated through a clutch, which movement is or is not transmitted depending on the requirements. The motor rotation is very high so it requires a gearbox, consisting of a number of steel gears and shafts, which reduces engine speed to be applied through gear box gimbals and differential boxes, to the wheel axles. A direct rotary circular configuration, equivalent in performance to the conventional configuration, required to move an automobile as described above, is composed of a compressor, a motor with static combustion chamber, and a hydraulic pump, all of which are united by an axle fixed to the rotors, plus two lateral hydraulic motors with variable speed rotor fixed to the shaft of the wheels and powered by a pressure hydraulic fluid line. A fundamental feature of this configuration is that it is not inertial, so it works only when it is required to move the car, i.e. accelerate or maintain its regime of movement or speed, which means a great fuel savings and a significant reduction of air pollution, in addition to prolonging its useful life. If added, fixed to the axles of each wheel, circular direct rotary compressors as a braking mechanism, in the braking process we gain compression for operating the engine, which accumulates to be used when it is required. This alternative configuration, full direct circular rotary, occupies a volume and has a weight of about one third of the traditional alternative. This affects all the rest of the configuration of the car, i.e. this configuration is much lighter and occupies less volume than traditional and does not need so strong of a support structure, resulting in a vehicle much lighter and therefore more economical, but without lowering benefits delivering traditional settings replaced.

The mechanics are much simpler and there are fewer moving parts. Thermodynamically it is also much more efficient because it performs every stage of optimum mechanical configurations. Another direct rotary circular configuration contemplated is the compressor and engine for use in aviation, which transforms rotation of the shaft directly to the propeller rotation, with all the advantages that this entails.

FIGURE DESCRIPTION

FIG. 1 Plan view of the side plate (1) and the passed drilling (1.1).

FIG. 2A Cross-section of the solid body (2), the cylindrical recess (2.1), the cavity (2.2), the cavity (2.3), the cavity (2.4), the cavity (2.5) and the cavity (2.6).

Figure 2B:
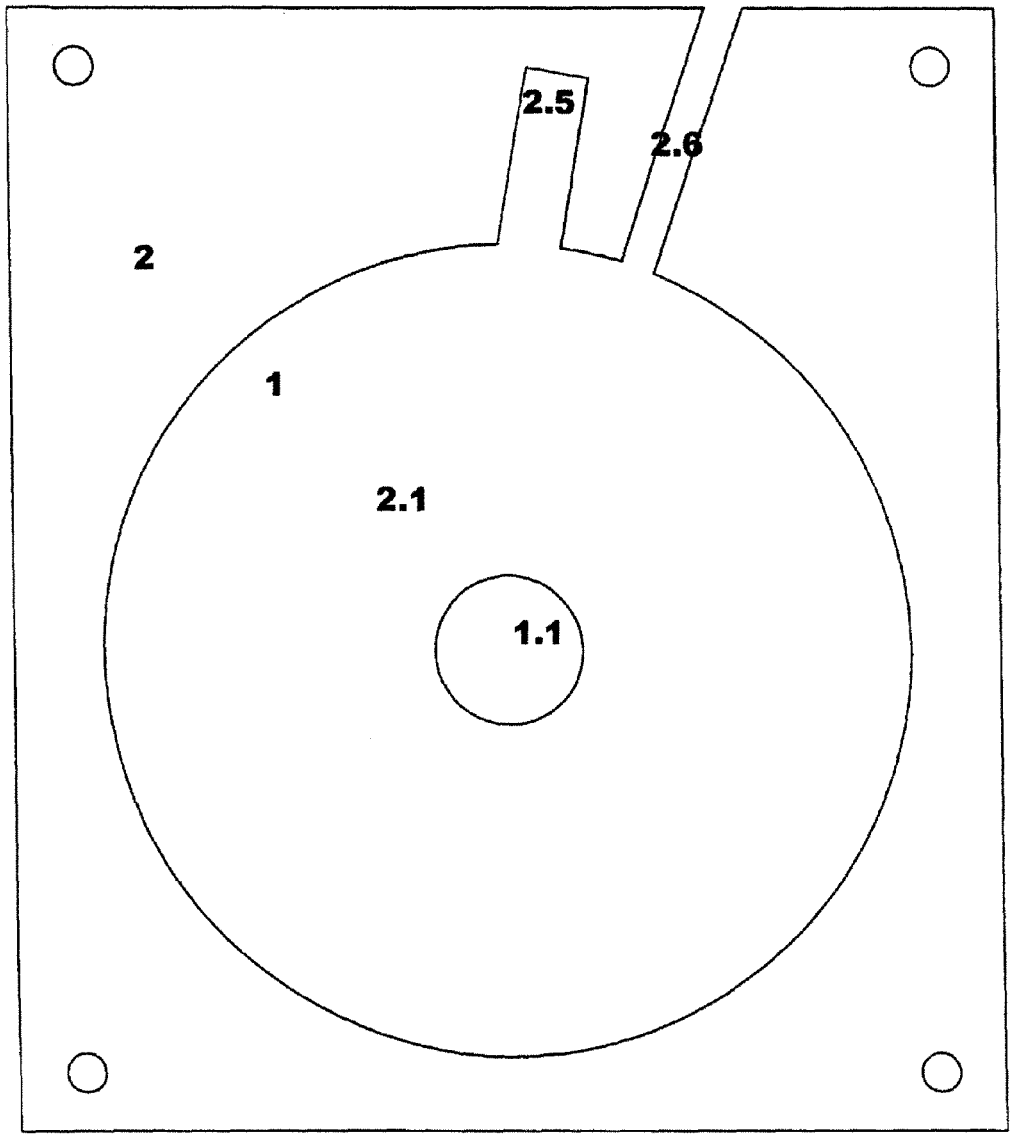

FIG. 2B Plan view of the solid body (2) fixed on the solid side (1) with its passed drilling (1.1), the cylindrical recess (2.1), the cavity (2.5) and (2.6).

Figure 3:
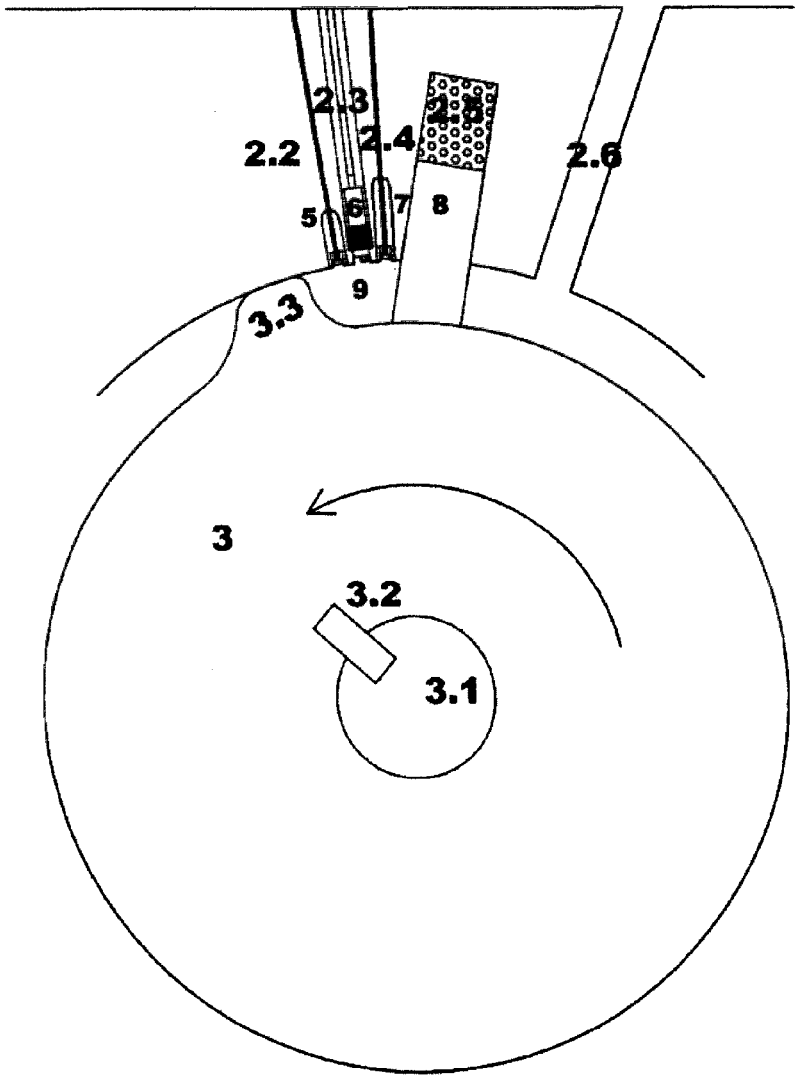

FIG. 3 Cross-section of the expander rotor (3), crossed perpendicularly by the shaft (3.1) fixed to it by the cotter pin (3.2) and the head expander (3.3).

Figure 4A:
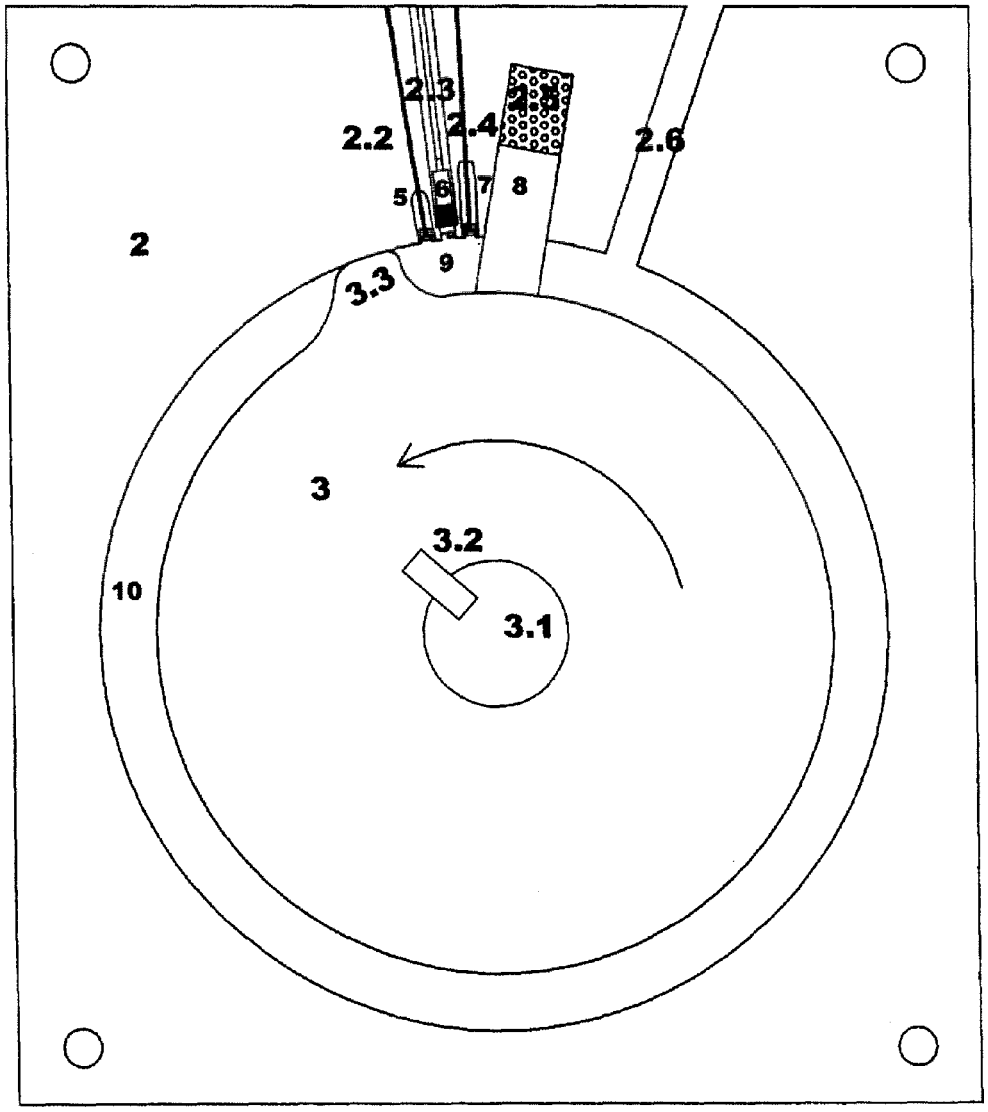
Figure 4B:
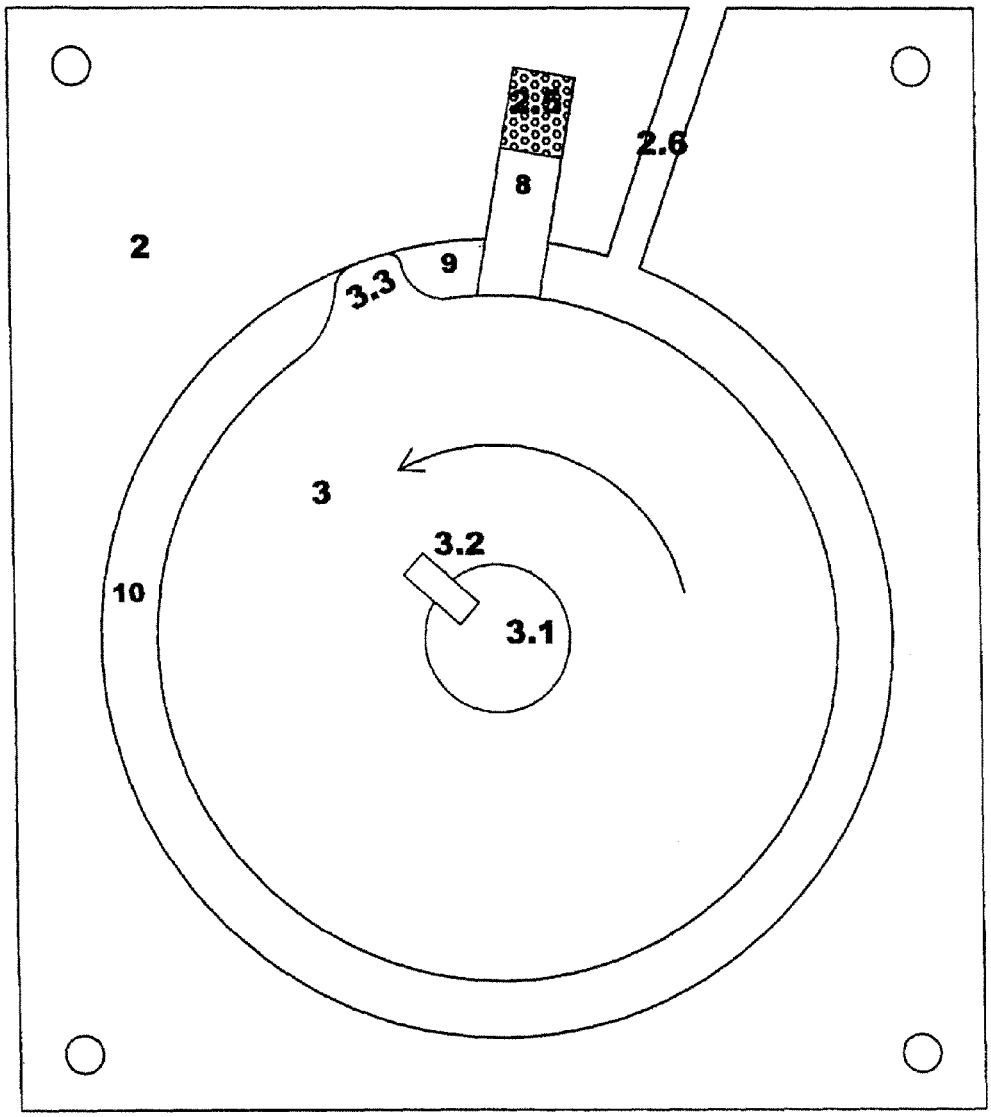

FIG. 4A Cross-section of the solid body (2), the cavity (2.2), the cavity (2.3), the cavity (2.4), the cavity (2.5) and the cavity (2.6) as out exhaust, cross-section of the oxidizer inlet valve (5) the spark plug (6), the fuel injection valve (7), the expansion valve (8), cross-section of the expander rotor (3), crossed perpendicularly by the axis (3.1) fixed to it by the cotter pin (3.2), the expander head (3.3), the expansion chamber (9) and the rear chamber (10).

FIG. 4B Plan view of the solid body (2), the cavity (2.5) containing the expansion valve (8), the exhaust outlet (2.6), the expander rotor (3) crossed perpendicularly by the axis (3.1) fixed to it by a cotter pin (3.2), the expander head (3.3), the expansion chamber (9) and the rear chamber (10).

Figure 5:
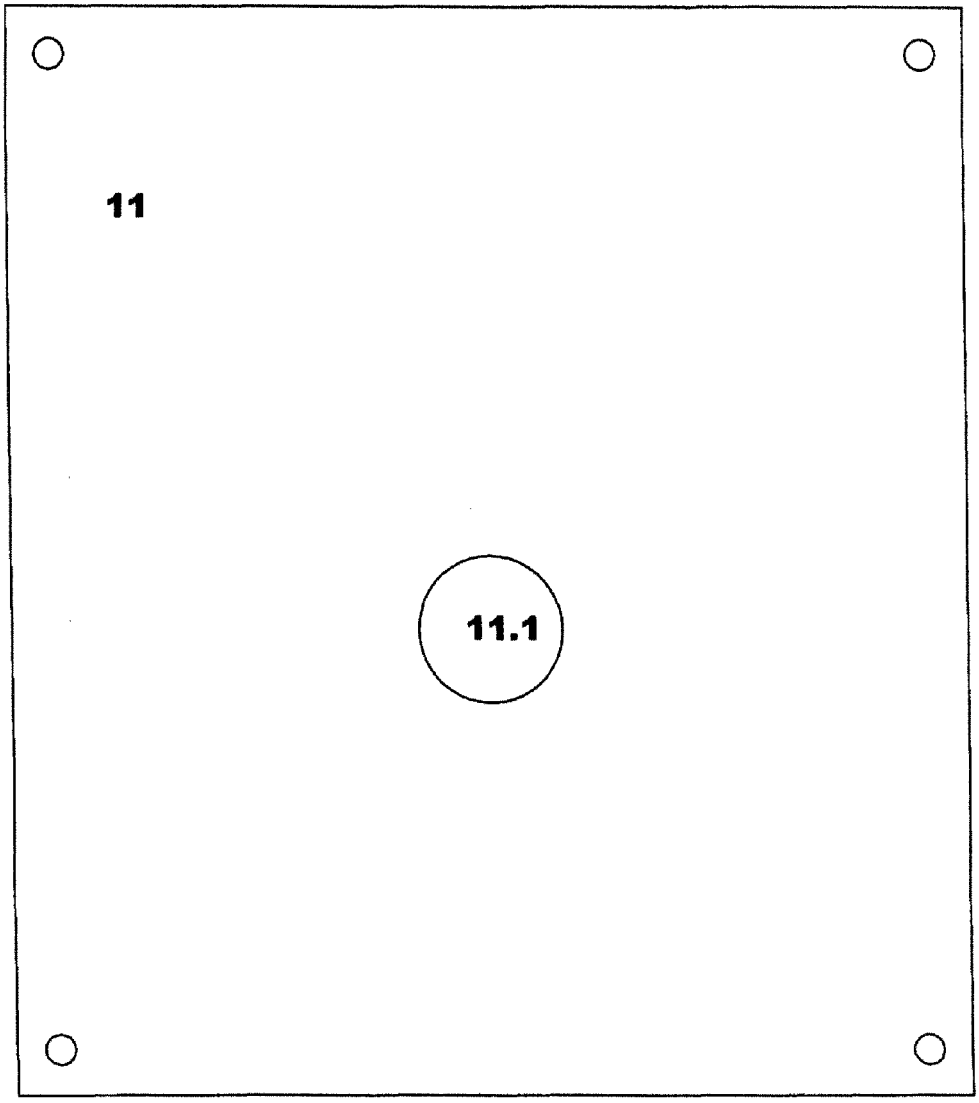

FIG. 5 Plan view of the second side plate (11) with the passing drilling (11.1).

Figure 6:
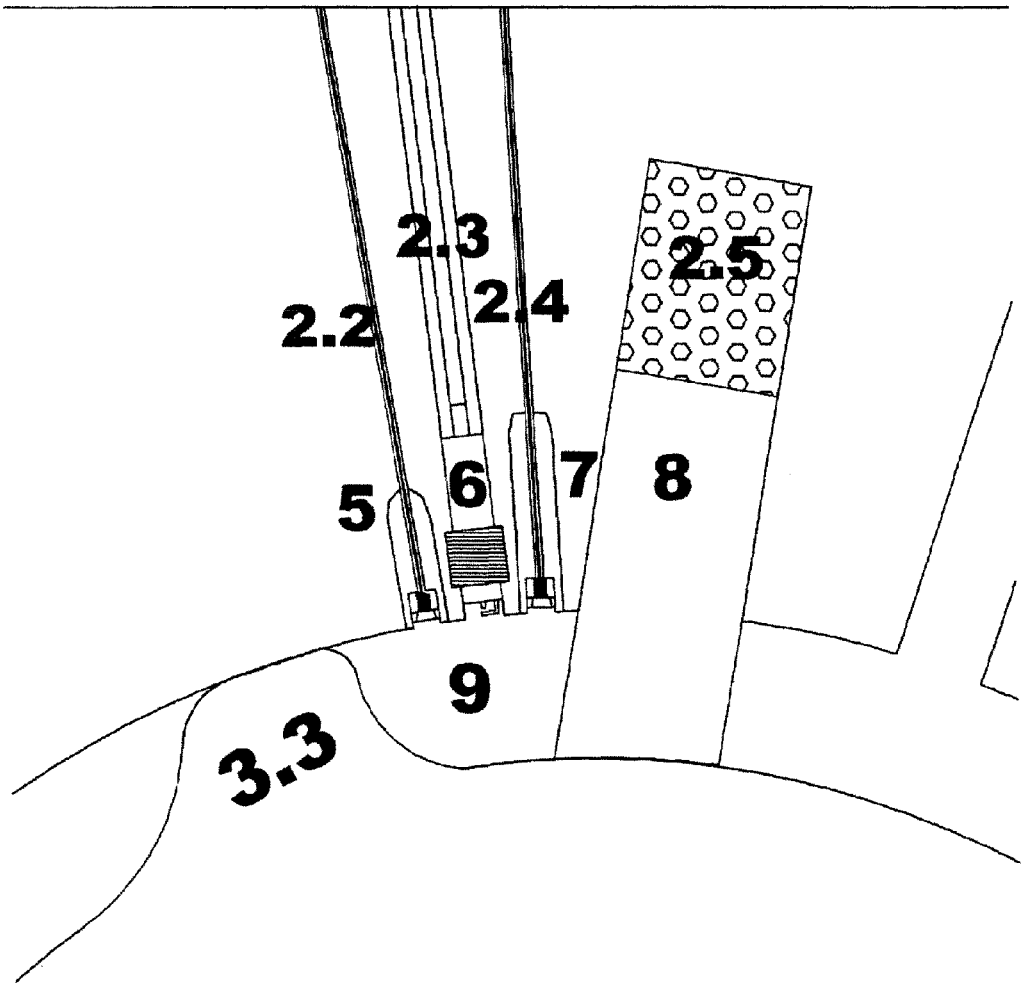

FIG. 6 Extended cross-section of the cavities (2.2) (2.3) (2.4) and (2.5) receiving the combustion intake valve (5) the spark plug (6), the fuel injection valve (7) and expansion valve (8), respectively, the expander head (3.3) and the combustion chamber (9).

Figure 7:
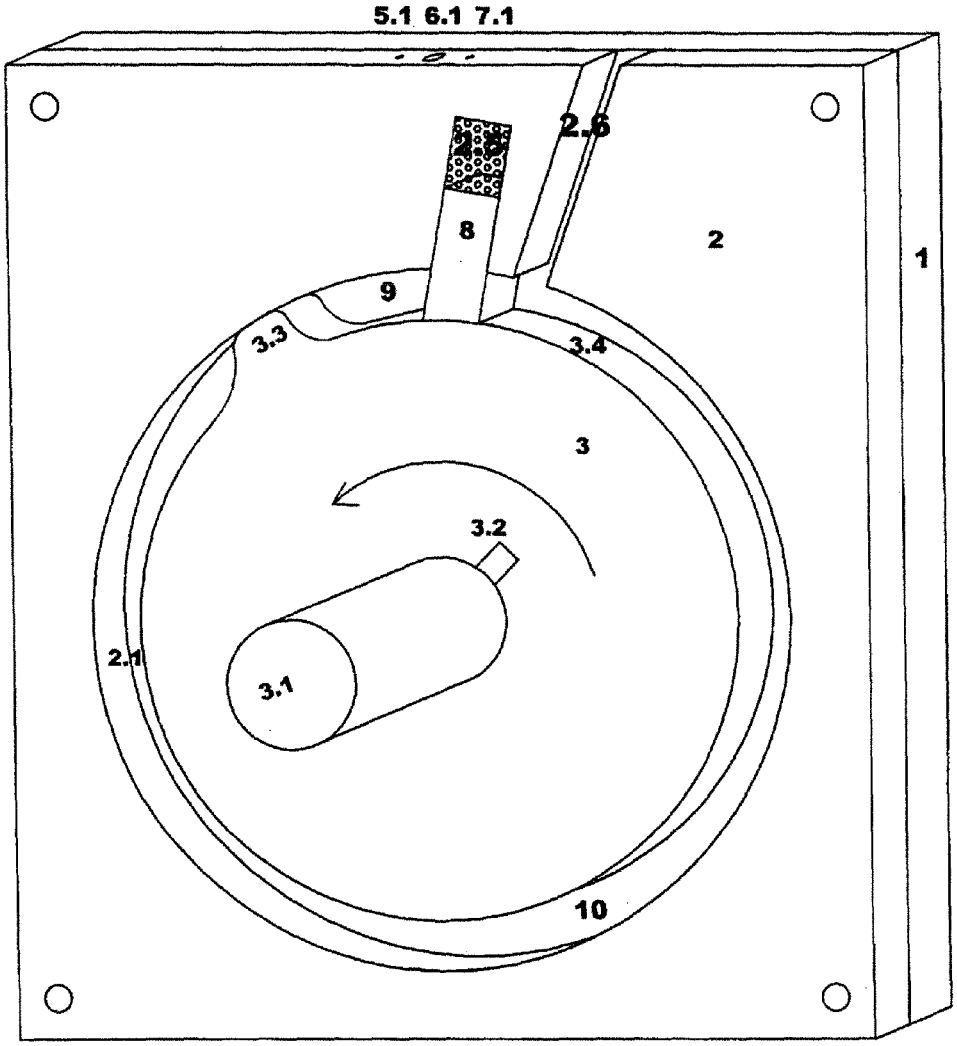

FIG. 7 Perspective from the FIG. 4B with expander rotor (3) in a more advanced position of the expander head (3.3), where you can see the face of the cylindrical recess (2.1) and the cylindrical face of the expander rotor (3.4), the output of the cavity of the oxidizer inlet valve (5.1), the output of cavity of the spark plug (6.1), the output of cavity of the fuel injection valve (7.1) and the exhaust outlet (2.6), the volumes of the expansion chamber (9) and the rear chamber (10).

FIG. 8 Ideal thermodynamic cycle of the rotary direct circular engine with Isochoric combustion and adiabatic expansion.

FIG. 9 Cross-section of the engine at the position of the expansion chamber (9) filled at external pressure, oxidizer inlet valve (5) closed, spark plug (6) off, the fuel injection valve (7) closed, expansion valve (8) closed and rear chamber (10) filled at external pressure.

Figure 10:
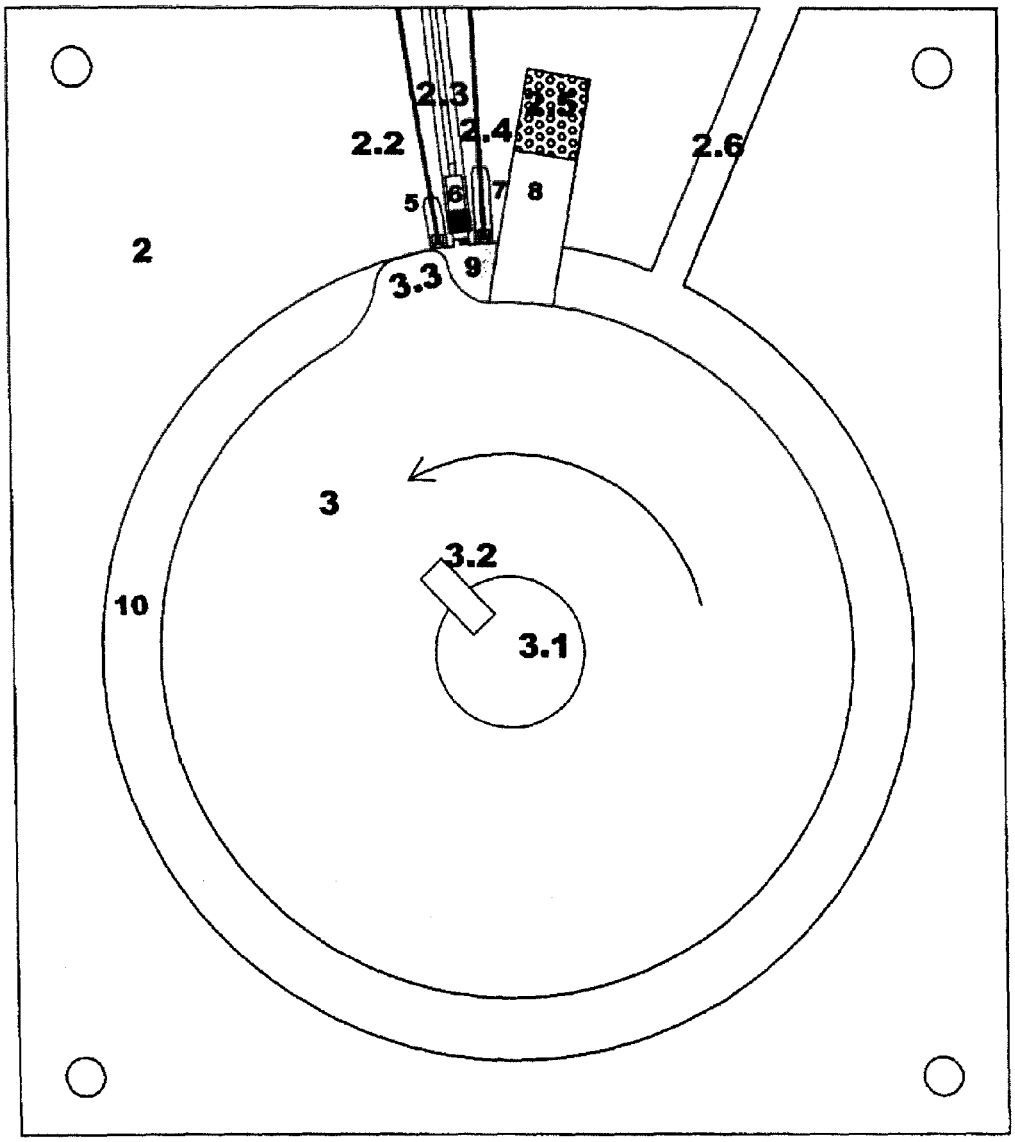

FIG. 10 Cross-section of the engine at the filled position of the expansion chamber (9), oxidizer intake valve (5) open, spark plug (6) off, the fuel injection valve (7) open, expansion valve (8) closed and rear chamber (10) filled at external pressure.

Figure 11:
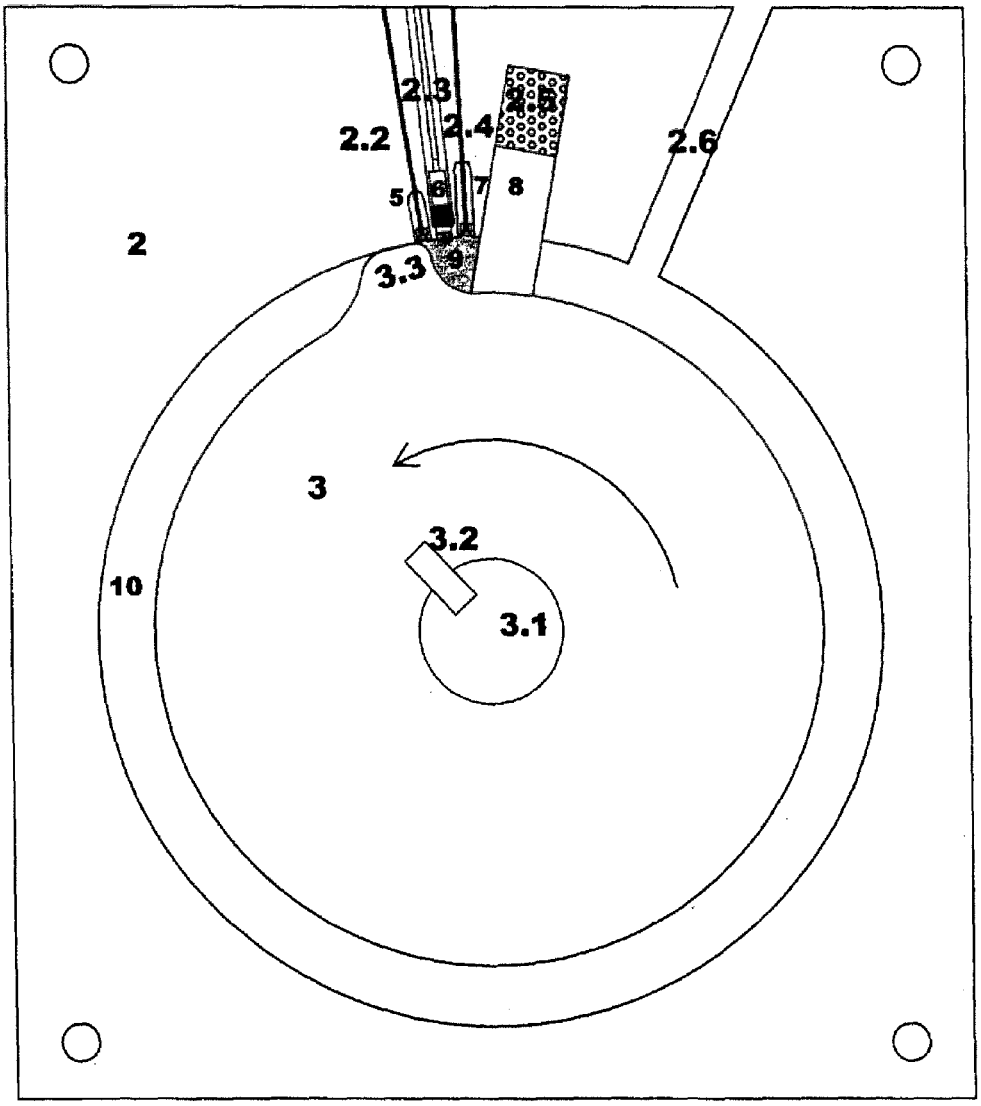

FIG. 11 Cross-section of the engine at the position of the expansion chamber (9) filled with maximum combustion pressure, the oxidizer inlet valve (5) closed, spark plug (6) on, the fuel injection valve (7) closed, expansion valve (8) closed and rear chamber (10) filled at external pressure.

Figure 12:
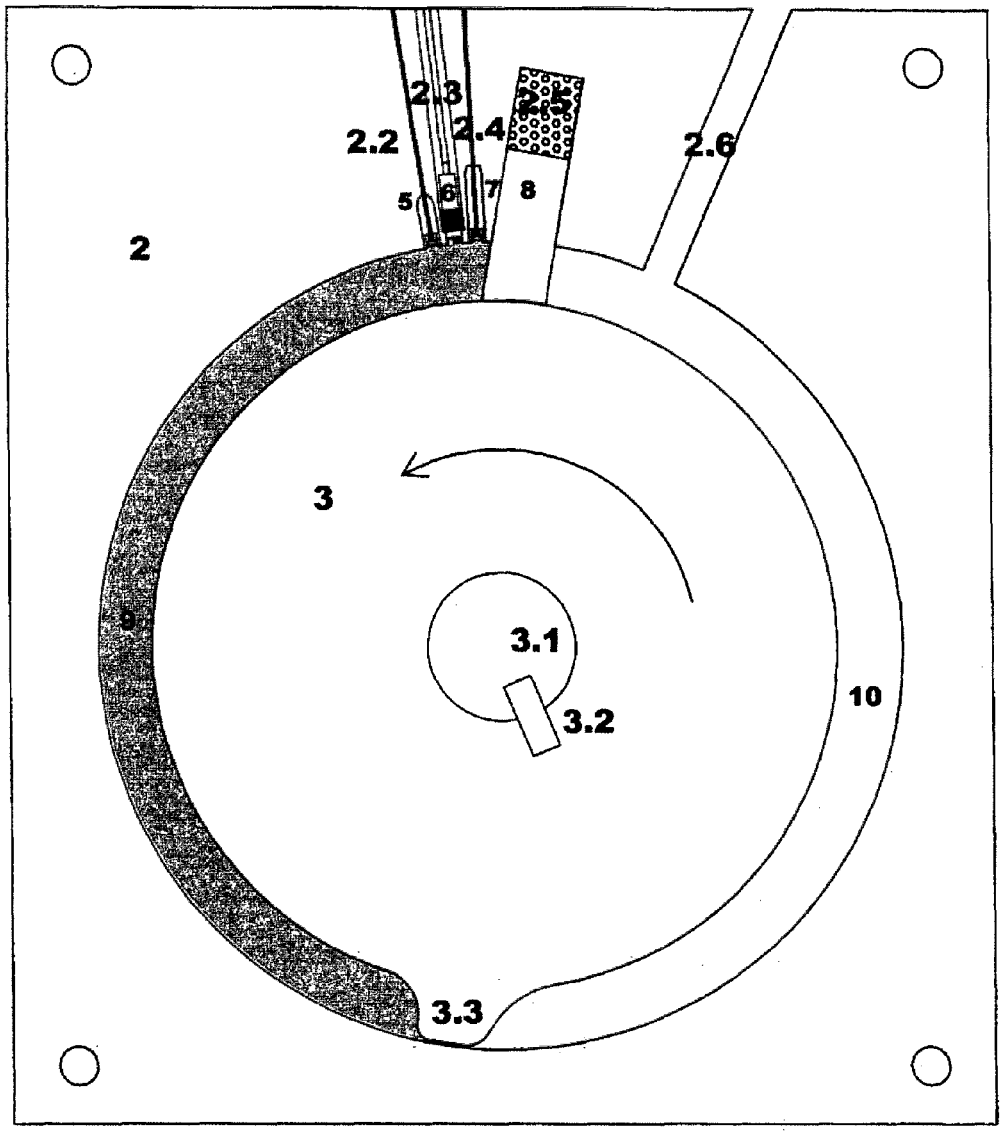

FIG. 12 Cross-section of the engine at the position of the expansion chamber (9) at half of its maximum volume, filled at combustion expansion pressure, oxidizer inlet valve (5) closed, spark plug (6) off, fuel injection valve (7) closed, expansion valve (8) closed and the rear chamber (10) filled to at pressure.

Figure 13:
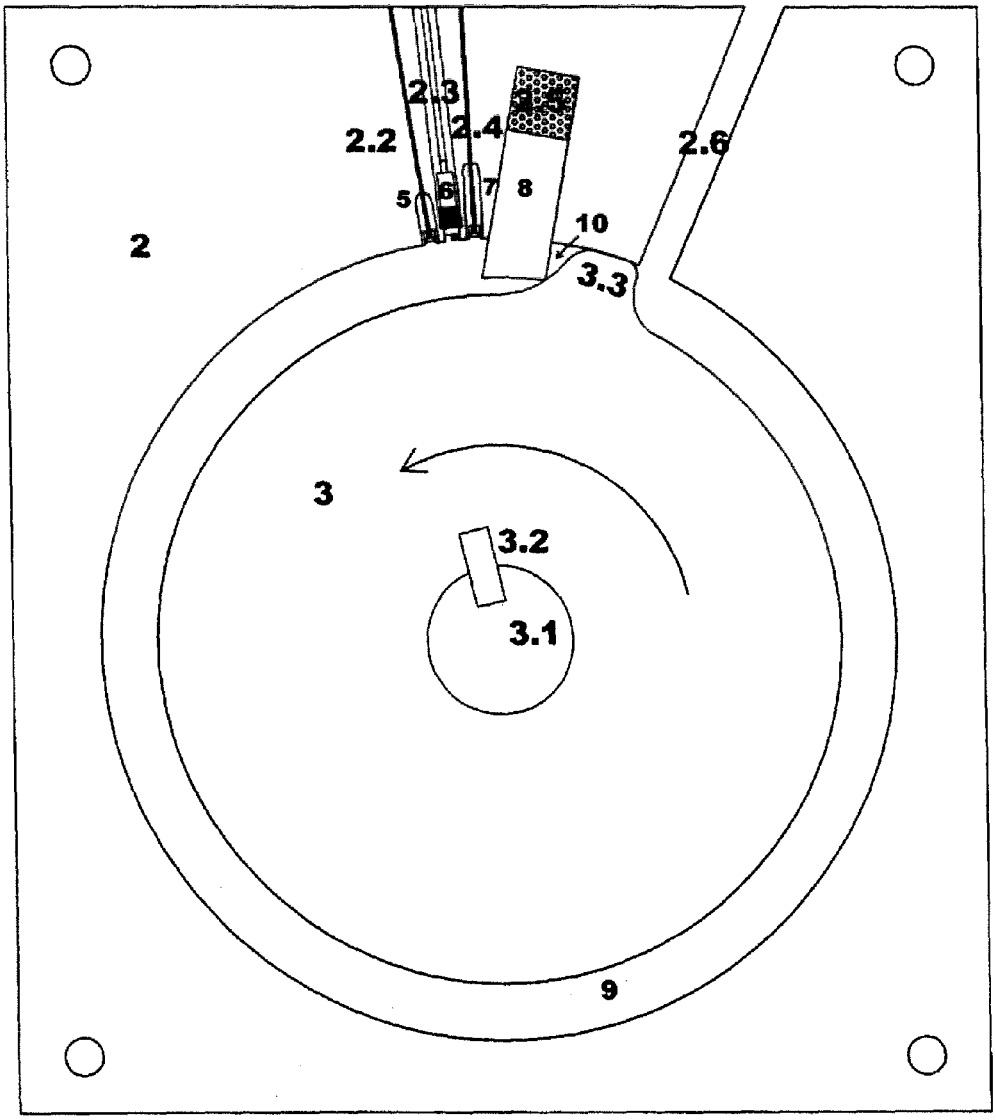

FIG. 13 Cross-section of the engine at the position of the expansion chamber (9) open to the outside, filled at external pressure, oxidizer inlet valve (5) closed, spark plug (6) off, the fuel injection valve (7) closed, expansion valve (8) open over the area of the rear face of the expander head and rear chamber (10) filled all at external pressure.

Figure 14:
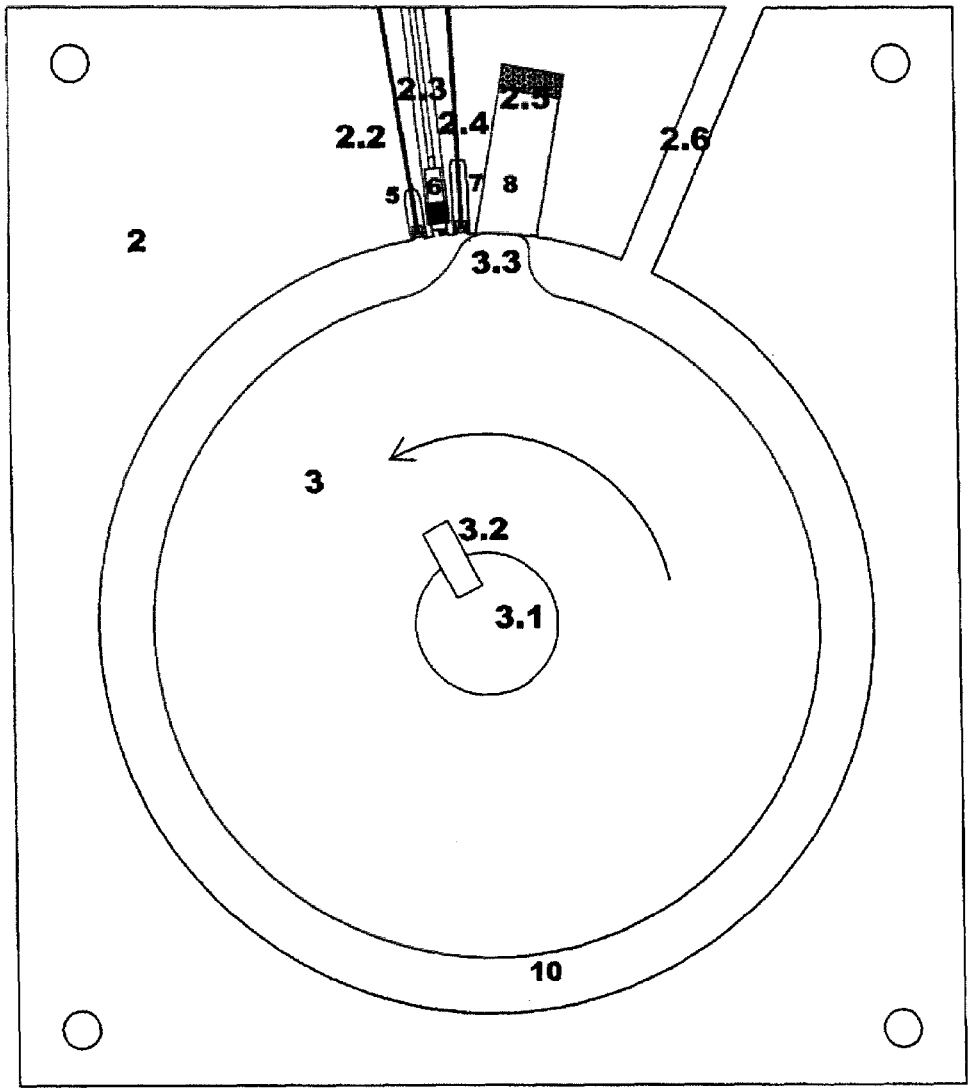

FIG. 14 Cross-section of the engine at the position of the expansion chamber (8) opened on the upper face of the expander head (3,3), the oxidizer inlet valve (5) closed, spark plug (6) off, the fuel injection valve (7) closed, rear chamber (10) filled at external pressure.

Figure 15:
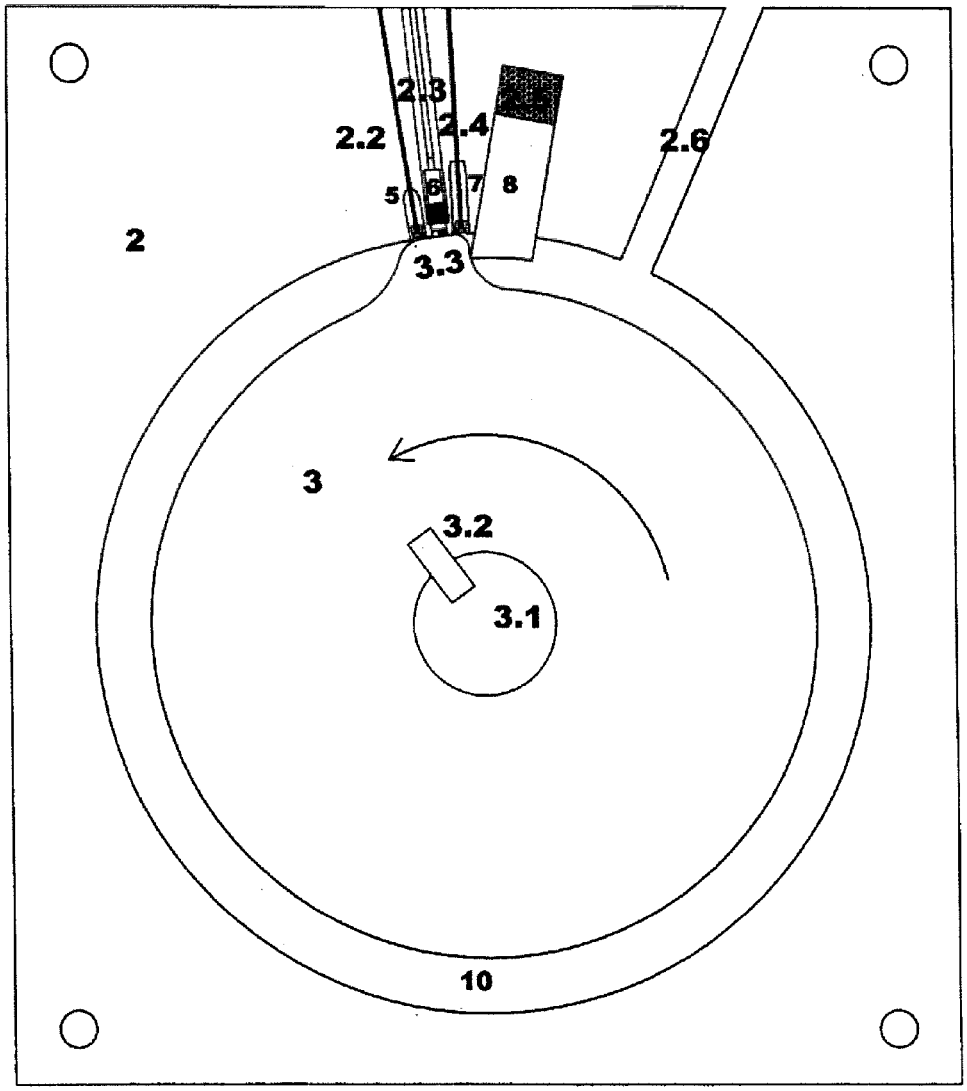

FIG. 15 Cross-section of the engine in the position of expansion valve (8) open over the expander head (3.3) face, oxidizer inlet valve (5) closed, spark plug (6) off, fuel injection valve (7) closed, rear camera (10) filled at external pressure.

Figure 16:
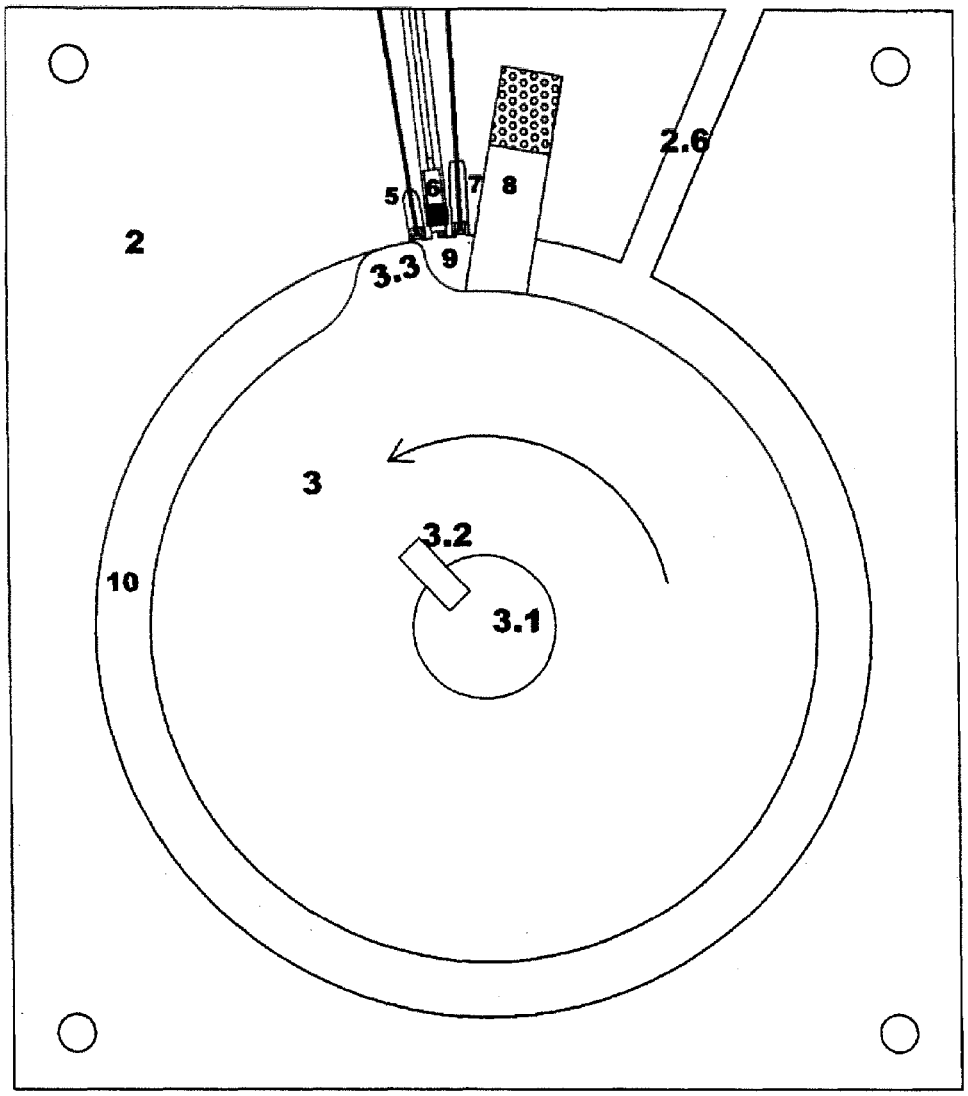
Figure 17:
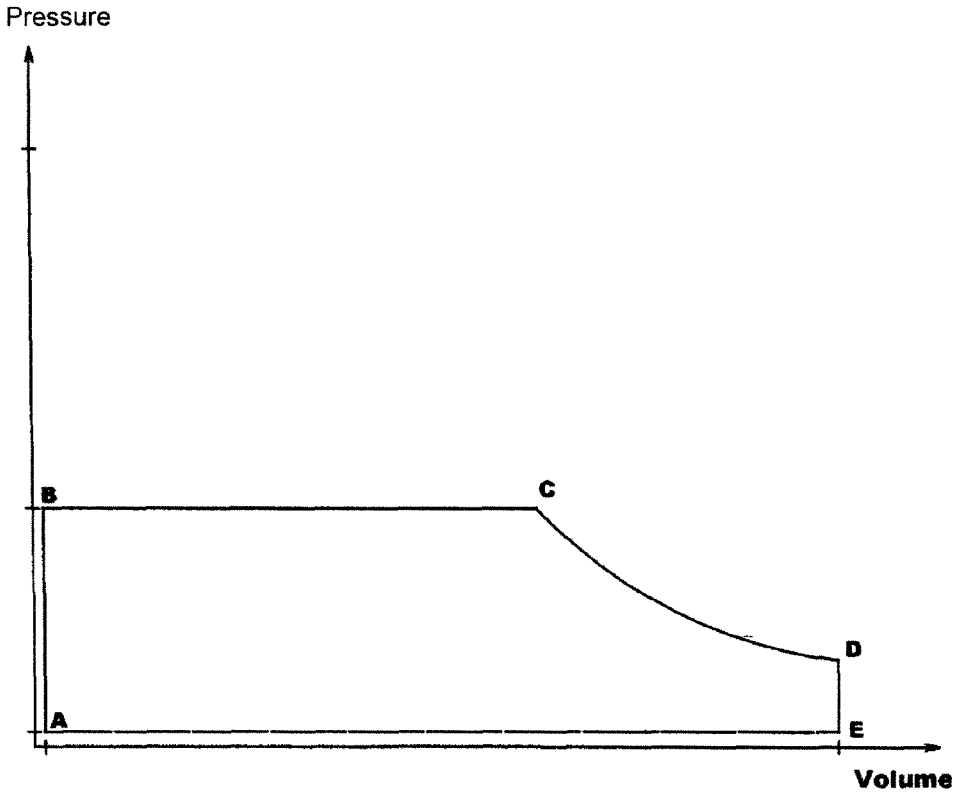

FIG. 16 Cross-section of the engine at the position of expansion chamber (9) filled to external pressure, oxidizer inlet valve (5) closed, spark plug (6) off, fuel injection valve (7) closed, expansion valve (8) closed and rear chamber (10 filled at external pressure. Corresponds to the beginning of the cycle, i.e. equals to FIG. 8.

FIG. 17 Ideal thermodynamic cycle of a isobaric and adiabatic expansion of the direct circular rotary internal combustion engine.

Figure 18:
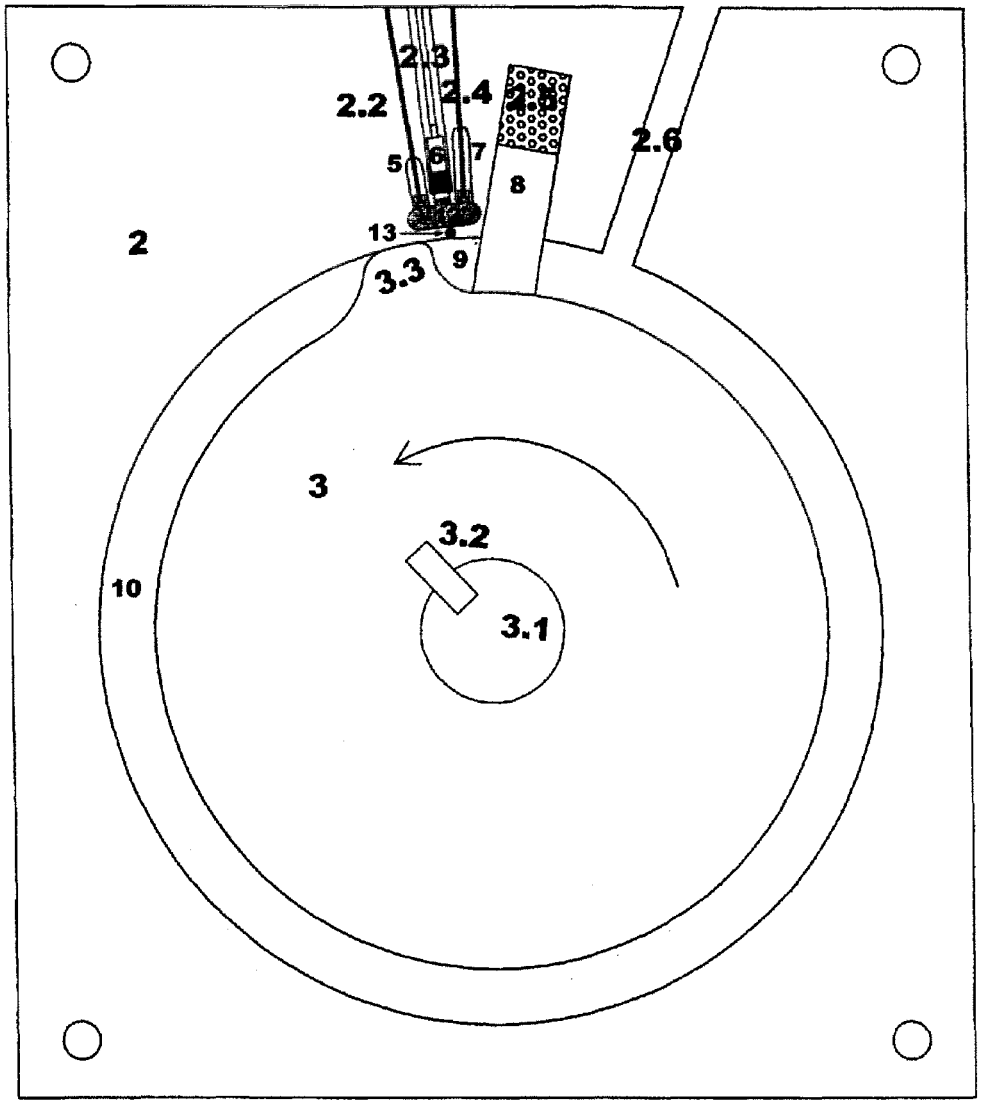

FIG. 18 Cross-section of the solid body (2), the volumetric emptying (12) corresponding to the filled static combustion chamber, the cavity (2.2), cavity (2.3) and cavity (2.4 transferred to the face of the spherical emptying (12), the cavity (2.5) and the cavity (2.6), cross-section of the oxidizer inlet valve (5) closed, the spark plug (6) off, the fuel injection valve (7) closed, the by-pass valve (13) closed, expansion valve (8) closed and the exhaust outlet (2.6), cross-section of expander rotor (3), crossed perpendicularly by the axis (3.1) fixed to it by the cotter pin (3.2), the head expander (3.3), the expansion chamber (9) and the rear chamber (10) filled at external pressure.

Figure 19:
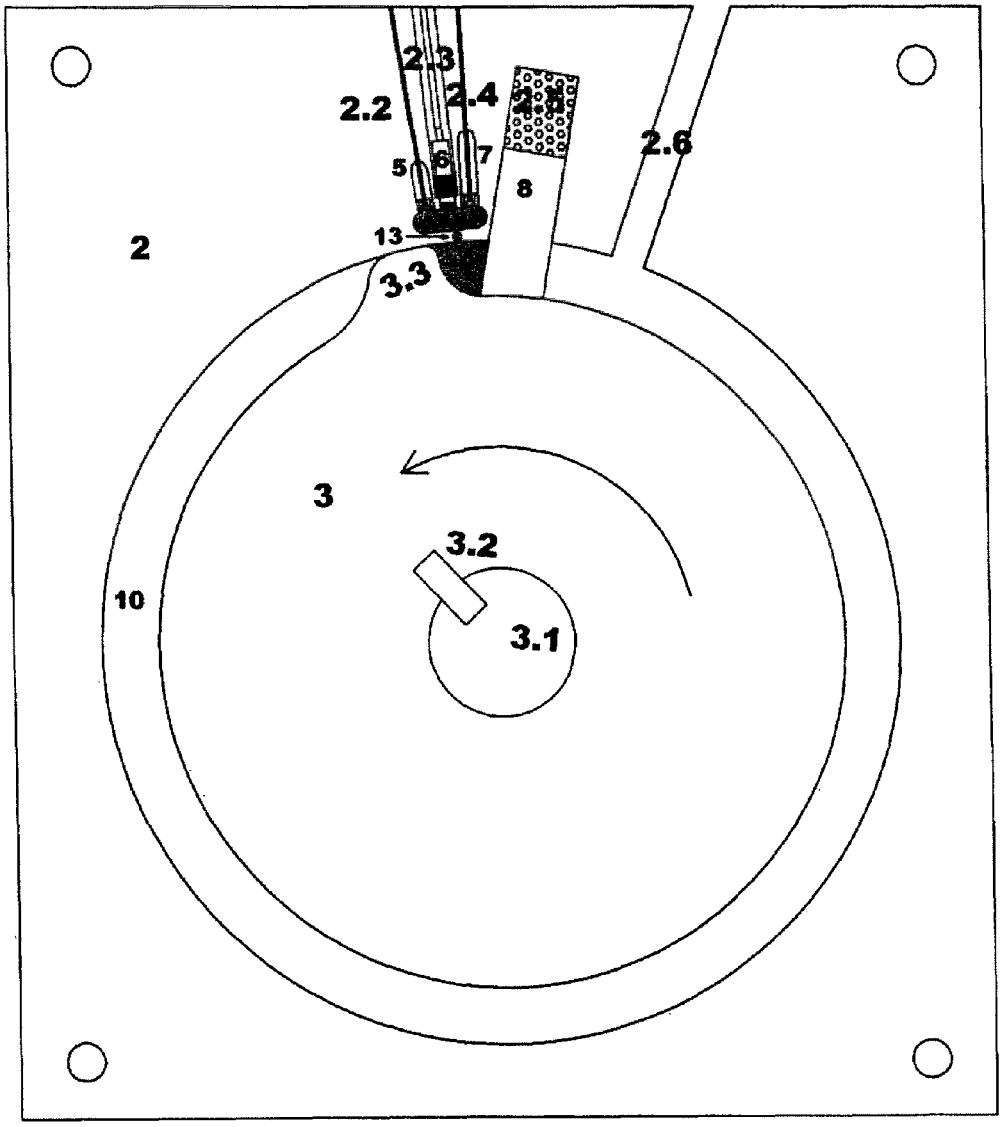

FIG. 19 Cross-section of the solid body (2), the volumetric emptying (12) corresponding to the filled static combustion chamber, the cavity (2.2), cavity (2.3) cavity (2.4) the cavity (2.5) and the cavity (2.6), cross-section of the oxidizer inlet valve (5) closed, the spark plug (6) off, the fuel injection valve (7) closed, the by-pass valve (13) open, expansion valve (8) closed and the exhaust outlet (2.6), cross-section of expander rotor (3), crossed perpendicularly by the axis (3.1) fixed to it by the cotter pin (3.2), the head expander (3.3), the expansion chamber (9) filled with maximum combustion pressure and the rear chamber (10) filled at external pressure.

Figure 20:
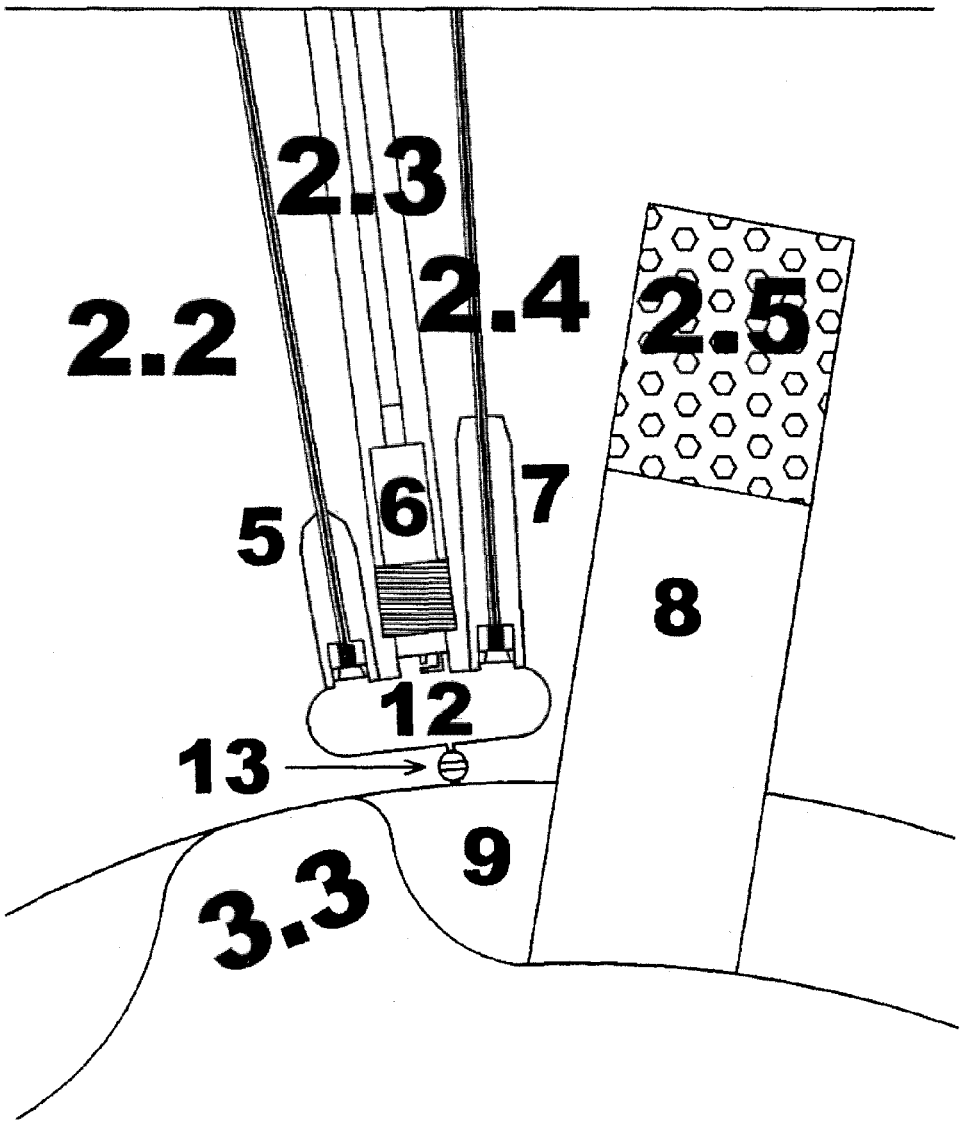

FIG. 20 Extended cross-section of the volumetric emptying (12) corresponding to the static combustion chamber, the cavity (2.2), cavity (2.3), cavity (2.4), cavity (2.5) and the cavity (2.6), cross-section of the oxidizer inlet valve (5) closed, the spark plug (6) off, the fuel injection valve (7) closed, the by-pass valve (13) closed and the expansion valve (8) closed, the head expander (3.3) and the expansion chamber (9) empty.

FIG. 21 Cross-section of the solid body (2), the cavity (2.7), cavity (2.5) and cavity (2.6), cross-section of the by-pass valve (13) closed, expansion valve (8) closed and the exhaust outlet (2.6), cross-section of expander rotor (3), crossed perpendicularly by the axis (3.1) fixed to it by the cotter pin (3.2), the head expander (3.3), the expansion chamber (9) and the rear chamber (10) filled at external pressure.

Figure 22:
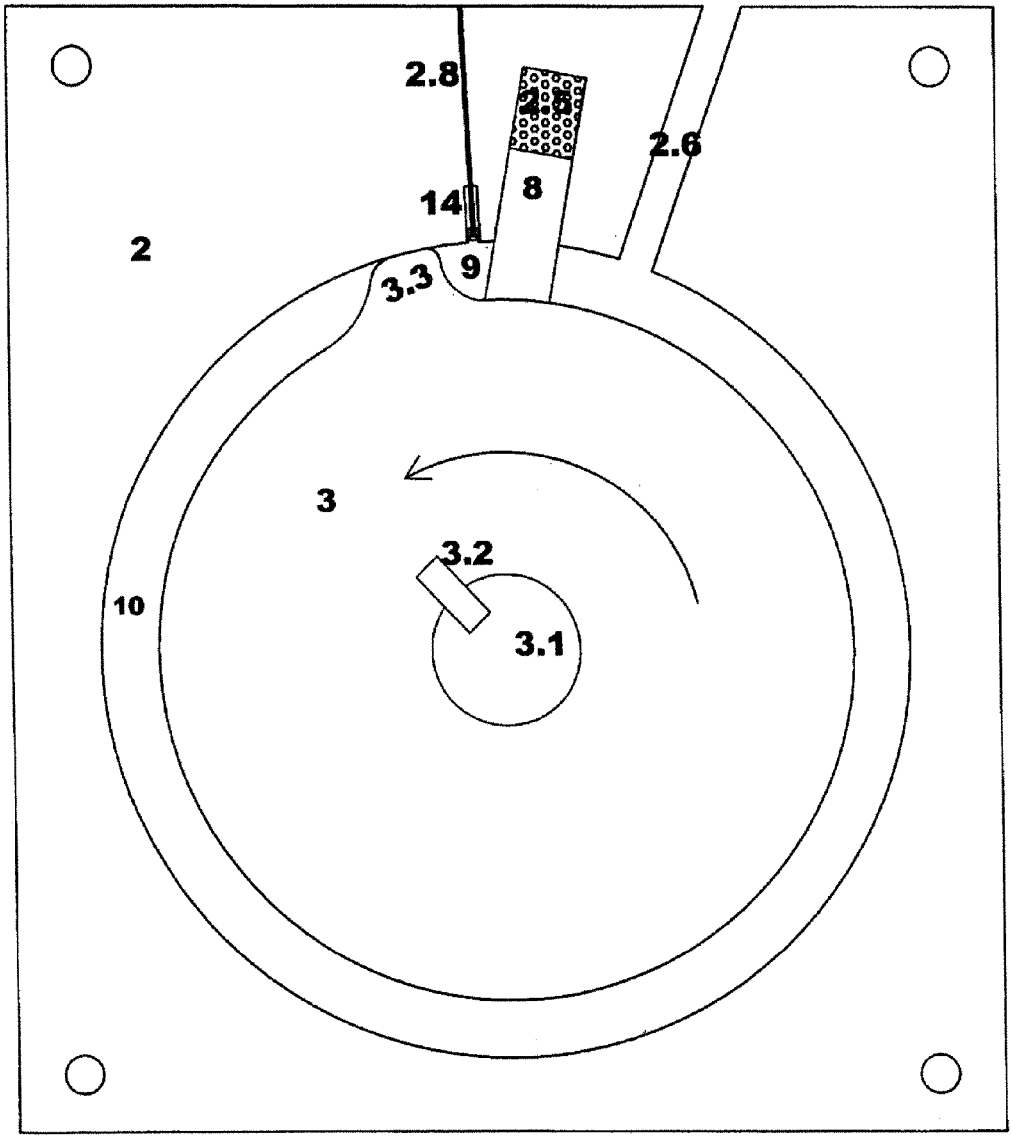

FIG. 22 Cross-section of the solid body (2), the cavity (2.8), cavity (2.5) and cavity (2.6) as exhaust outlet, cross-section of the inlet valve (14) closed, the expansion valve (8) closed, cross-section of expander rotor (3), crossed perpendicularly by the axis (3.1) fixed to it by the cotter pin (3.2), the head expander (3.3), the expansion chamber (9) and the rear chamber (10) filled at external pressure.

Figure 23:
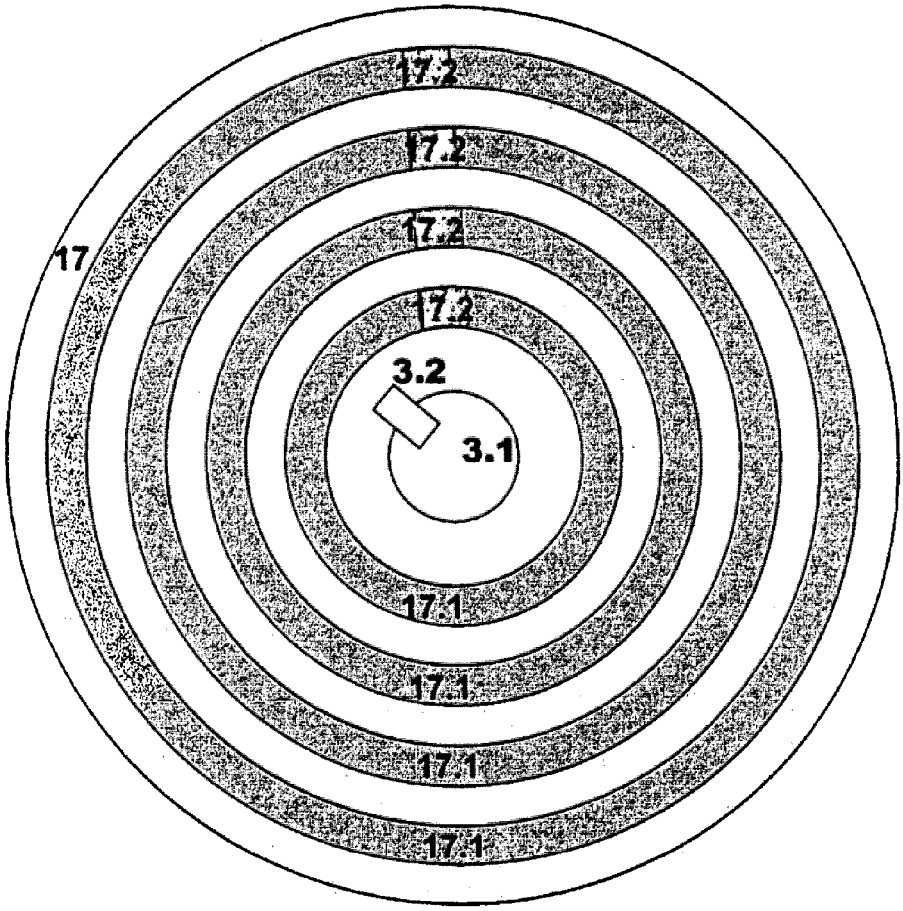

FIG. 23 Plan view of the expander lateral rotor (17), crossed perpendicularly by the axis (3.1) fixed to it by the cotter pin (3.2), the circular grooves (17.1) and heads expanders (17.2).

Figure 24:
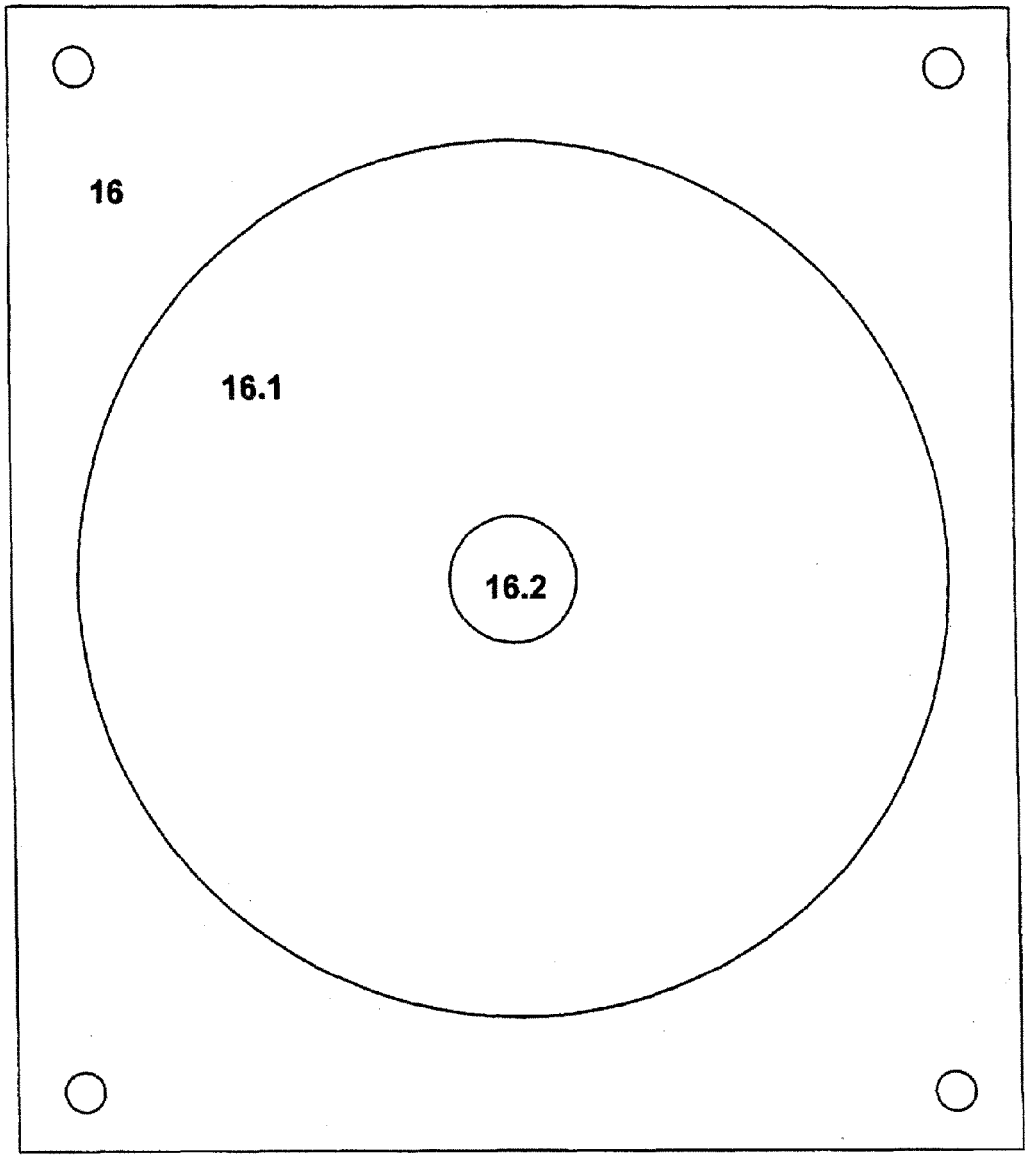

FIG. 24 Plan view of the solid side plate (16), the cylindrical recess (16.1) and the drilling passing (16.2).

Figure 25:
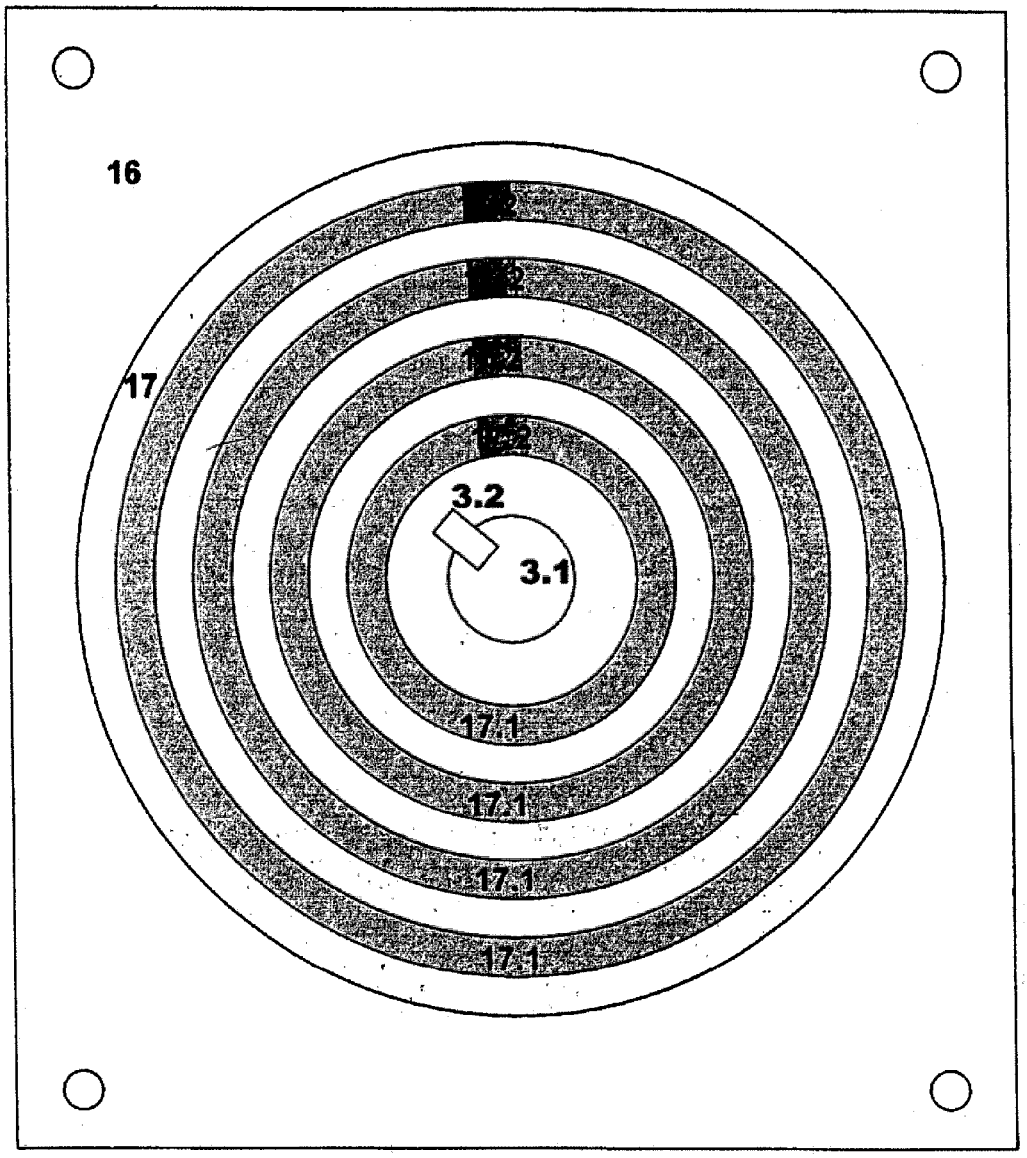

FIG. 25 Plan view of the solid side plate (16) with the expander rotor (17) perfect fit, crossed perpendicularly by the axis (3.1) fixed to it by the cotter pin (3.2), the circular grooves (17.1) and heads expanders (17.2).

Figure 26:
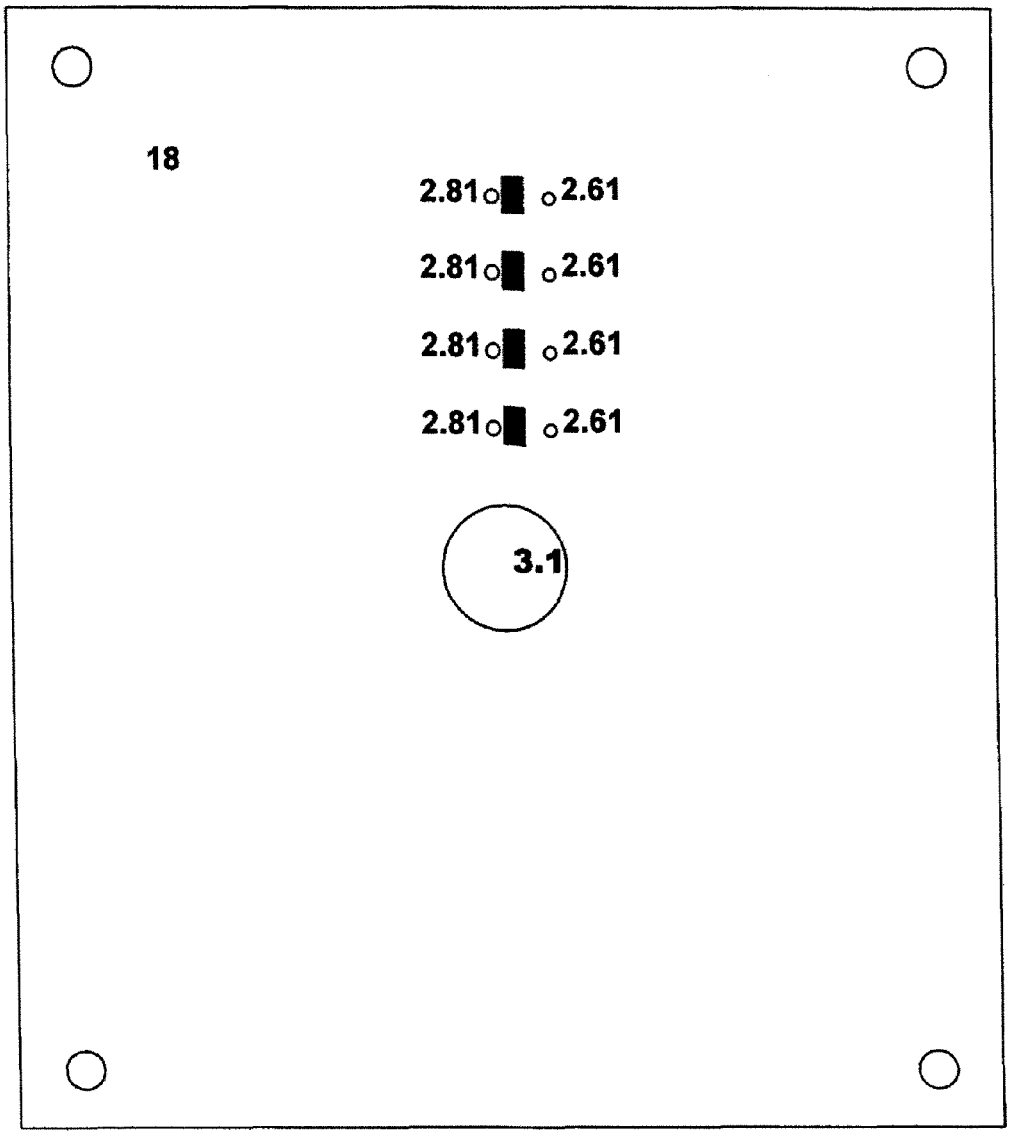
Figure 27:
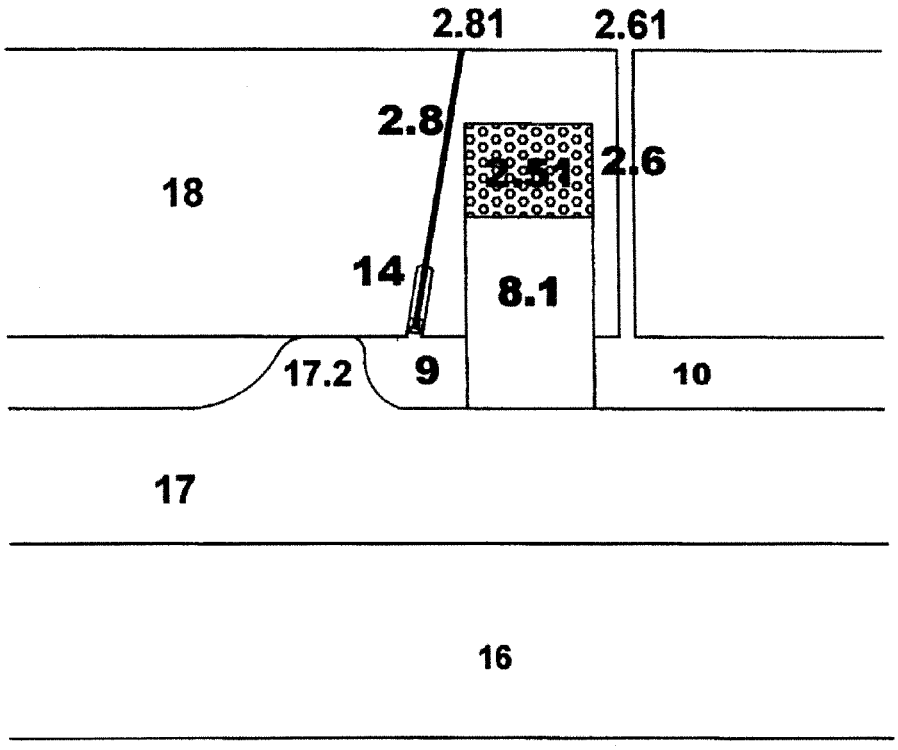

FIG. 26 Plan view of the solid side plate (18) crossed perpendicularly by the axis (3.1), with the output of de cavities for the intake valve (2.81) and exhaust outlet (2.61), FIG. 27 Cross-section of the lateral engine built by the solid side plate (16) with the rotor (17) and it expander head (17.2) perfectly matched to the solid lateral plate (18) with the cavity (2.8) and its output (2.81) for the Intake valve of a pressurized oxidizer (14), the expansion valve (8.1) located in the cavity (2.51), the exhaust outlet (2.6) and its output (2.61), the expansion chamber (9) and the rear chamber (10).

FIG. 28 Cross-section of the solid body (2), the cavities (2.8), (2.5) and (2.6), cross-section of outlet valve (14) closed, compression valve (8) closed and the emptying of admission (2.6), the compressor rotor (3), crossed perpendicularly by the axis (3.1) fixed by the cotter pin (3.2), the compressor head (3.3), the compression chamber (9) and the rear camera (10) at external pressure.

Figure 29:
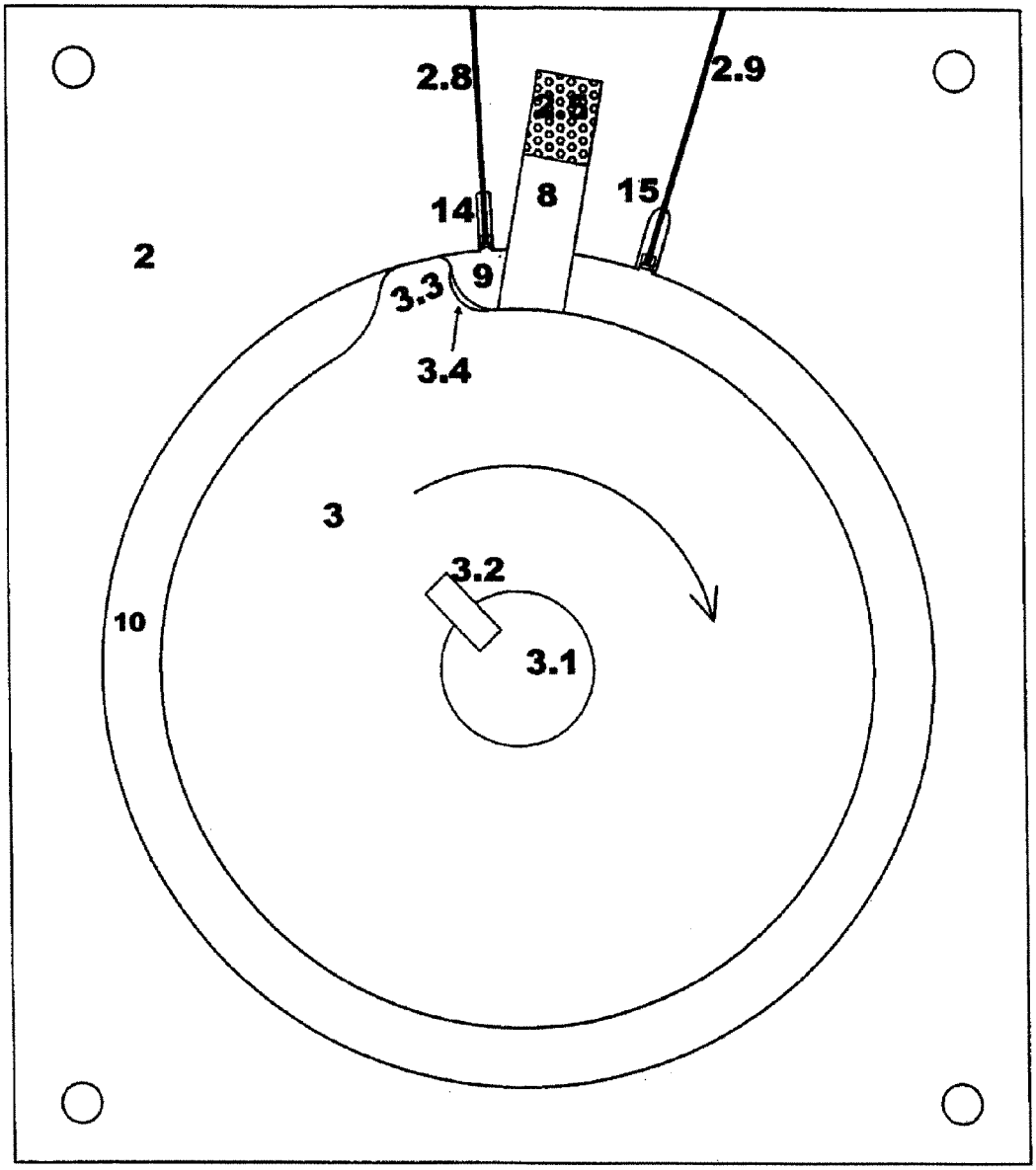

FIG. 29 Cross-section of the solid body (2), cavities (2.8), (2.5) and (2.9), cross-section of the outlet valve (14) open, compression valve (8) closed and the intake valve (15) closed, the compressor rotor (3), crossed perpendicularly by the axis (3.1) fixed by the cotter pin (3.2), the compressor head (3.3), the grooves along the face of the head compressor (3.4), the compression chamber (9) and the rear camera (10).

Figure 30:
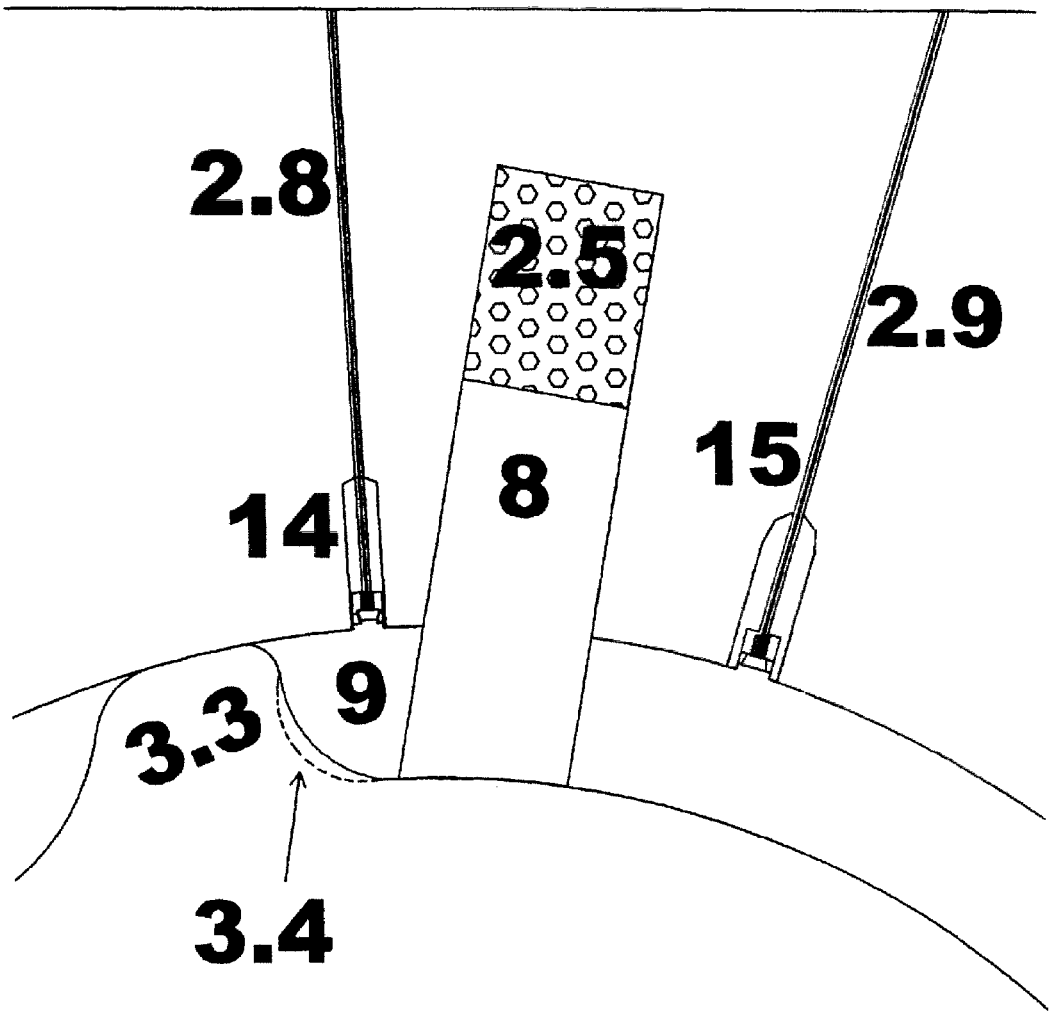

FIG. 30 Extended cross-section of the cavity (2.8), cavity (2.5), cavity (2.9), outlet valve (14) open, compression valve (8) closed and the intake valve (15) closed, the compressor head (3.3), the grooves along the face of the compressor head (3.4) and the compression chamber (9).

The invention claimed is:

1. A direct circular rotary internal combustion engine comprising:

a first side plate comprising a first hole centrally located in the first side plate;

a body fixed to the first side plate, wherein the body comprises:

a cylindrical hole concentric with the first hole of the first side plate;

a static combustion chamber connected to the cylindrical hole of the body by a by-pass valve, the static combustion chamber comprising first, second, and third inner recesses where the first, second, and third inner recesses house an intake valve of a pressurized oxidizer, a spark plug, and a fuel injection valve, respectively;

a first cavity containing an expansion valve angled with respect to a radius of the cylindrical hole; and a second cavity forming an exhaust outlet open to the cylindrical hole;

a cylindrical expander rotor coupled to the first side plate by a shaft extending perpendicular through a center of the cylindrical expander rotor, wherein the shaft passes through the first hole of the first side plate centering the shaft in the cylindrical hole of the body, the cylindrical expander rotor comprising an expander head extending from an outer wall of the cylindrical expander rotor to contact an inner surface of the cylindrical hole of the body; and a second side plate fixed to an opposite side of the body from the first side plate, wherein the second side plate comprises a second hole centrally located in the second side plate to receive the shaft, wherein the expansion valve is also contained by a first side plate cavity in the first side plate and a second side plate cavity in the second side plate, the first side plate cavity and the second side plate cavity configured to securely receive the expansion valve.

2. The direct circular rotary internal combustion engine according to claim 1, wherein the angled expansion valve contains expanding fluid and wherein a sealing contact is maintained between the expansion valve and a cylindrical face of the expander rotor by a mechanical or pneumatic element.

3. The direct circular rotary internal combustion engine according to claim 2, wherein the fluid is hydraulic.

4. The direct circular rotary internal combustion engine according to claim 2, wherein the fluid is gas.

5. The direct circular rotary internal combustion engine according to claim 1, further comprising:

an expansion chamber, wherein the expansion chamber is formed by a cylindrical face of the cylindrical hole, a cylindrical outer wall of the expander rotor, the expander head of the expander rotor, a front wall of the expansion valve and walls of the first and second side plates.

6. The direct circular rotary internal combustion engine according to claim 5, wherein the body comprises at least two static combustion chambers connected to the expansion chamber by bypass valves.

7. The direct circular rotary internal combustion engine according to claim 5 further comprising:

a plurality of expansion chambers, wherein the plurality of expansion chambers are formed by a cylindrical face of the cylindrical hole, a cylindrical outer wall of the expander rotor, the expander head of the expander rotor, a front wall of the expansion valve and walls of the first and second side plates.

8. The direct circular rotary internal combustion engine according to claim 7, further comprising:

an expansion valve in each of the plurality of expansion chambers which selectively enables or disables the expansion chamber.

9. The direct circular rotary internal combustion engine according to claim 1, wherein the cylindrical expander rotor comprises at least two expander heads.

10. A direct circular rotary internal combustion engine comprising:

a first side plate comprising a first hole centrally located in the first side plate;

a body fixed to the first side plate, wherein the body comprises:

a cylindrical hole concentric with the first hole of the first side plate;

a static combustion chamber connected to the cylindrical hole of the body by a by-pass valve, the static combustion chamber comprising first, second, and third inner recesses where the first, second, and third inner recesses house an intake valve of a pressurized oxidizer, a spark plug, and a fuel injection valve, respectively;

a first cavity containing an expansion valve angled with respect to a radius of the cylindrical hole, wherein the expansion valve contains expanding hydraulic fluid; and a second cavity forming an exhaust outlet open to the cylindrical hole;

a cylindrical expander rotor coupled to the first side plate by a shaft extending perpendicular through a center of the cylindrical expander rotor, wherein the shaft passes through the first hole of the first side plate centering the shaft in the cylindrical hole of the body, the cylindrical expander rotor comprising an expander head extending from an outer wall of the cylindrical expander rotor to contact an inner surface of the cylindrical hole of the body, wherein a sealing contact is maintained between the expansion valve and a cylindrical face of the expander rotor by a mechanical or a pneumatic element; and a second side plate fixed to an opposite side of the body from the first side plate, wherein the second side plate comprises a second hole centrally located in the second side plate to receive the shaft.

11. The direct circular rotary internal combustion engine according to claim 10, further comprising:

an expansion chamber, wherein the expansion chamber is formed by a cylindrical face of the cylindrical hole, a cylindrical outer wall of the expander rotor, the expander head of the expander rotor, a front wall of the expansion valve and walls of the first and second side plates.

12. The direct circular rotary internal combustion engine according to claim 11, wherein the body comprises at least two static combustion chambers connected to the expansion chamber by bypass valves.

13. The direct circular rotary internal combustion engine according to claim 11 further comprising:

a plurality of expansion chambers, wherein the plurality of expansion chambers are formed by a cylindrical face of the cylindrical hole, a cylindrical outer wall of the expander rotor, the expander head of the expander rotor, a front wall of the expansion valve and walls of the first and second side plates.

14. The direct circular rotary internal combustion engine according to claim 13, further comprising:

an expansion valve in each of the plurality of expansion chambers which selectively enables or disables the expansion chamber.

15. The direct circular rotary internal combustion engine according to claim 10, wherein the cylindrical expander rotor comprises at least two expander heads.

16. The direct circular rotary internal combustion engine according to claim 10, wherein the expansion valve is also contained by a first side plate cavity in the first side plate and a second side plate cavity in the second side plate, the first side plate cavity and the second side plate cavity being configured to securely receive the expansion valve.

* * * * *